US009039009B2

(12) United States Patent
Oshiro et al.

(10) Patent No.: US 9,039,009 B2
(45) Date of Patent: May 26, 2015

(54) SHEET FEED APPARATUS AND SHEET FEED METHOD

(71) Applicants: KABUSHIKI KAISHA TOSHIBA, Tokyo (JP); TOSHIBA TEC KABUSHIKI KAISHA, Tokyo (JP)

(72) Inventors: Toshiaki Oshiro, Shizuoka-ken (JP); Ken Iguchi, Shizuoka-ken (JP); Isao Yahata, Shizuoka-ken (JP); Kikuo Mizutani, Shizuoka-ken (JP); Hiroyuki Taki, Shizuoka-ken (JP); Chiaki Iizuka, Shizuoka-ken (JP); Hidetoshi Yokochi, Shizuoka-ken (JP); Yoshiaki Sugizaki, Shizuoka-ken (JP); Takahiro Kawaguchi, Shizuoka-ken (JP); Hiroyuki Tsuchihashi, Shizuoka-ken (JP); Hiroyuki Hazu, Shizuoka-ken (JP); Yoichi Yamaguchi, Shizuoka-ken (JP); Hiroyuki Sugiyama, Shizuoka-ken (JP); Yuichi Saito, Shizuoka-ken (JP); Jun Ishii, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/107,956

(22) Filed: Dec. 16, 2013

(65) Prior Publication Data

US 2014/0147136 A1 May 29, 2014

Related U.S. Application Data

(63) Continuation of application No. 13/524,852, filed on Jun. 15, 2012, now Pat. No. 8,636,282.

(60) Provisional application No. 61/499,152, filed on Jun. 20, 2011, provisional application No. 61/540,519, filed on Sep. 28, 2011.

(51) Int. Cl.
*B65H 7/06* (2006.01)
*B65H 7/18* (2006.01)
(Continued)

(52) U.S. Cl.
CPC .. *B65H 7/20* (2013.01); *B65H 7/18* (2013.01); *B65H 7/14* (2013.01); *B65H 1/266* (2013.01);
(Continued)

(58) Field of Classification Search
CPC ..... B65H 7/06; B65H 7/18; B65H 7/14
USPC ..... 271/258.01, 265.01
See application file for complete search history.

(56) References Cited

U.S. PATENT DOCUMENTS 8,201,823 B2 6/2012 Morikawa et al.

FOREIGN PATENT DOCUMENTS

JP H08-119492 5/1996
JP H09-226980 2/1997

(Continued)

OTHER PUBLICATIONS

Office Action dated Apr. 1, 2014, filed in corresponding Japanese Patent Application No. 2012-137188, with English translation.

*Primary Examiner* — Luis A Gonzalez
(74) *Attorney, Agent, or Firm* — Patterson & Sheridan LLP

(57) ABSTRACT

A sheet feed apparatus which includes a sheet feed tray in which a plurality of sheets is loaded in piles; a sheet feed roller which is provided at a forward position of the sheet feed tray in a sheet feed direction, and sends the loaded sheets inside thereof; and a lift detection sensor which detects, by using a movable lever, a lift of a sheet bundle which occurs when the sheet bundle, of which a rear or a side in a sheet feed direction is bound, is sent by the sheet feed roller therein, the lift detection sensor being provided at a side position of the sheet bundle in a width direction and at a backward position with respect to the center of the sheet bundle in the sheet feed direction.

10 Claims, 18 Drawing Sheets

(51) Int. Cl.

| | |
|---|---|
| ***B65H 7/20*** | (2006.01) |
| ***B65H 7/14*** | (2006.01) |
| ***B65H 1/26*** | (2006.01) |
| ***B65H 7/12*** | (2006.01) |

(52) U.S. Cl.
CPC ..... *B65H 7/06* (2013.01); *B65H 2405/11425* (2013.01); *B65H 2511/51* (2013.01); *B65H 2511/515* (2013.01); *B65H 2511/521* (2013.01); *B65H 2511/528* (2013.01); *B65H 2513/512* (2013.01); *B65H 2553/612* (2013.01); *B65H 2553/80* (2013.01); *B65H 7/125* (2013.01)

(56) References Cited

FOREIGN PATENT DOCUMENTS

| | | |
|---|---|---|
| JP | 2004-182449 | 7/2003 |
| JP | 2007-137655 | 6/2007 |
| JP | 2008-230759 | 10/2008 |
| JP | 2009-292573 | 12/2009 |
| JP | 2012-051718 | 3/2012 |

SHEET FEED APPARATUS AND SHEET FEED METHOD

CROSS-REFERENCE TO RELATED APPLICATIONS

This application is based upon and claims the benefit of priority from: U.S. patent application Ser. No. 13/524,852, filed on Jun. 15, 2012, U.S. Provisional Patent Applications Ser. No. 61/499,152 filed on Jun. 20, 2011 and Ser. No. 61/540,519 filed on Sep. 28, 2011, the entire contents of each of which are incorporated herein by reference.

FIELD

Embodiments described herein relate generally to a sheet feed apparatus and sheet feed method.

BACKGROUND

An image forming apparatus such as a copy machine, or a facsimile, an image reading apparatus such as a scanner, a color erasing apparatus which erases a printed sheet using a special toner, or the like frequently uses a sheet feed apparatus which continuously feeds a plurality of sheets into the apparatus.

This type of sheet feed apparatus loads a plurality of sheets in a loading unit in piles, and sends sheets one by one into the apparatus from the top of a bundle of sheets. Accordingly, the plurality of sheets which is loaded in the loading unit has to be loaded in a state of being separated one by one, respectively.

However, due to an operational error, or a mistake by a user, there may be a case where a bound sheet bundle of a plurality of sheets which is bound by a staple, a clip, glue, or the like, is placed in the loading unit. When the bound sheet bundle is carried into a main body of the apparatus such as the image reading apparatus, or the color erasing apparatus, there is a problem in that a paper jam occurs in the apparatus, or an internal part of the apparatus is damaged. Therefore, in the sheet feed apparatus, a variety of measures for preventing the bound sheet bundle from being sent into the main body of the apparatus is taken.

For example, a "lift" of a sheet bundle, which occurs when abound sheet bundle is fed, is detected by a "lift" detection unit, using a light emitting element and a light receiving element, as disclosed in JP-A 2009-292575.

However, in the sheet feed apparatus, paper dust is easily generated since sheets rub against each other. For this reason, when configuring the "lift" detection unit using the light emitting element and the light receiving element, there is a possibility that the generated paper dust is attached to the surface of the light emitting element or the light receiving element, and deteriorates a detection performance thereof.

In addition, the light emitting element and the light receiving element are arranged in positions in an upper part of a sheet feed tray in which the sheets are loaded, accordingly, the light emitting element and the light receiving element are usually exposed outside of the apparatus. For this reason, the light receiving element is easily affected by external light such as the westering sun, or room light, accordingly there is a possibility of an occurrence of a detection error due to the external light.

Therefore, a sheet feed apparatus is desired which includes a highly reliable "lift" detection unit which is not affected by paper dust, external light, or the like.

DESCRIPTION OF THE DRAWINGS

In accompanying drawings.

DETAILED DESCRIPTION

Embodiment of the sheet feed apparatus and the sheet feed method will be described with reference to accompanying drawings.

The sheet feed apparatus according to the embodiment includes a sheet feed tray in which a plurality of sheets is loaded in piles; a sheet feed roller which is provided at a forward position of the sheet feed tray in a sheet feed direction, and sends the loaded sheets inside thereof; and a lift detection sensor which detects, by using a movable lever, a lift of a sheet bundle which occurs when the sheet bundle, of which a rear or a side in a sheet feed direction is bound, is sent by the sheet feed roller therein, the lift detection sensor being provided at a side position of the sheet bundle in a width direction and at a backward position with respect to the center of the sheet bundle in the sheet feed direction.

(1) First Embodiment (1-1) Configuration

Figure 1:
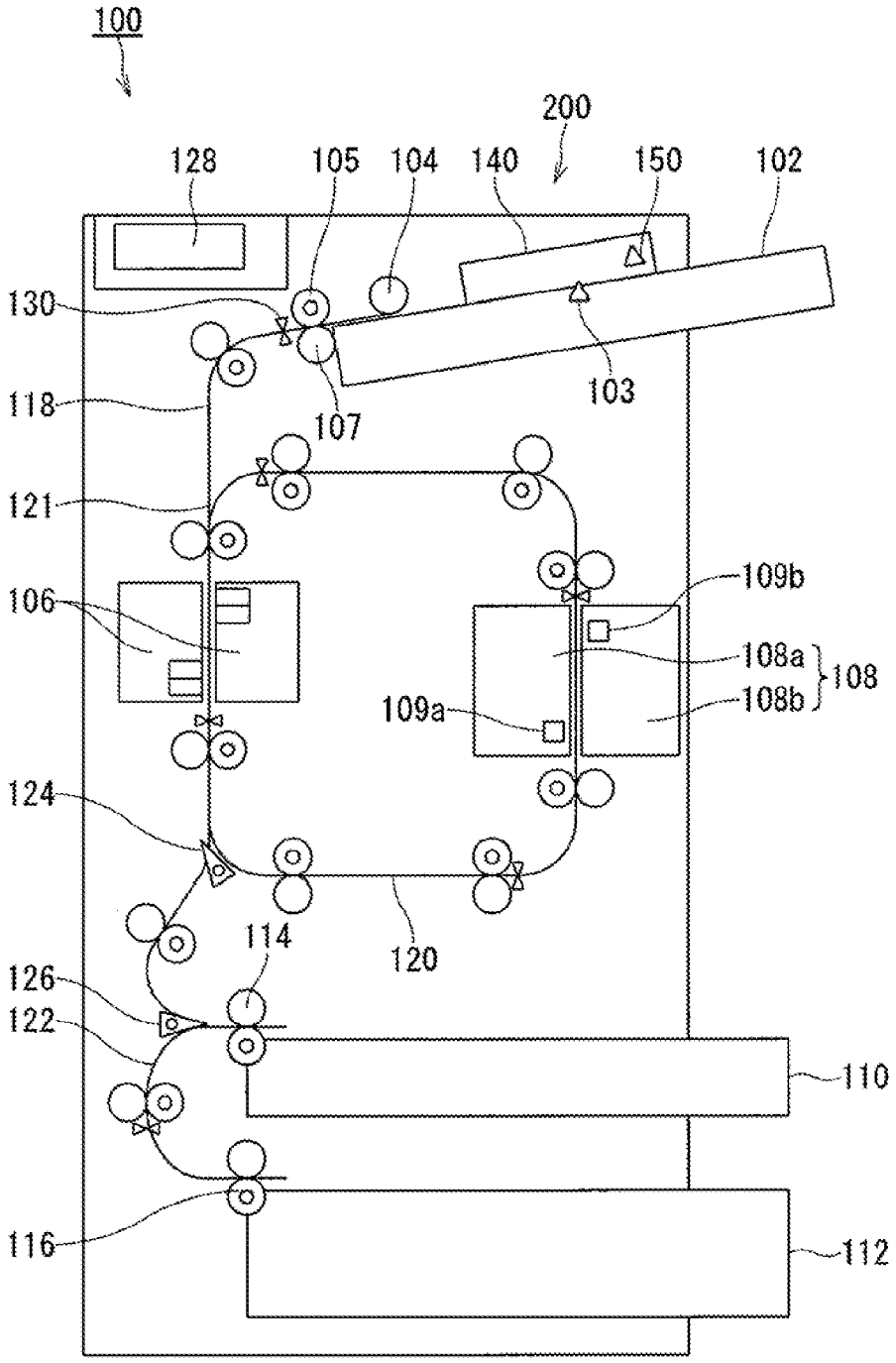
FIG. 1 is a diagram which shows an example configuration of a color erasing apparatus as an example embodiment of a sheet feed apparatus according to an embodiment.

FIG. 1 is a diagram which shows a configuration example when the sheet feed apparatus according to the embodiment is applied to a color erasing apparatus 100. The color erasing apparatus 100 performs "color erasing processing" which erases colors of an image which is printed using an "erasable color material" (hereinafter, simply referred to as a recording material) such as erasable toner, or erasable ink with respect to a sheet on which an image is formed using the erasable color material. The color erasing apparatus 100 includes a sheet feed unit 200, a reading unit 106, a color erasing unit 108, a first tray 110, a second tray 112, discharge rollers 114 and 116, a first conveying path 118, a second conveying path 120, a third conveying path 122, a first branching member 124, a second branching member 126, and an operation unit 128.

In the above configuration, the sheet feed unit 200 includes a sheet feed tray 102, a pickup roller 104, a sheet feed roller 105, a separation roller 107, a control unit 201 (refer to FIG. 2), or the like.

The sheet feed tray 102 loads sheets to be reused. The sheet feed tray 102 loads sheets of a variety of sizes of A4, A3, B5, or the like. The sheets loaded in the sheet feed tray 102 are sheets, for example, on which images are formed using a recording material of which color is erased by being heated at a predetermined temperature or more.

The pickup roller 104, the sheet feed roller 105, and the separation roller 107 which is arranged so as to face the sheet feed roller 105 send the sheet on the sheet feed tray 102 one by one into the first conveying path 118 in the color erasing apparatus 100. The sheet feed tray 102 includes a load detection sensor 103 which detects the presence of the sheet on the sheet feed tray 102. The load detection sensor 103 may be, for example, a micro sensor, or a micro actuator.

In addition, the sheet feed tray 102 is provided with a regulating member 140 which regulates a position of the loaded sheet in the width direction. A lift detection sensor 150 is provided inside the regulating member 140, and in the vicinity thereof. The structure and operation of the lift detection sensor 150 will be described later.

The first conveying path 118 forms a conveying path which goes toward the first tray 110 from the sheet feed tray 102. A sheet feed detection sensor 130 which detects the passage of the sheet is arranged in front of the sheet feed roller 105 and the separation roller 107 in the sheet feed direction. The sheet feed detection sensor 130 is a sensor, for example, which is turned on when the front end of the sheet passes through, and is turned off when the rear end of the sheet passes through. The first conveying path 118 conveys the fed sheet to the reading unit 106, or the first tray 110.

The reading unit 106 is arranged along the first conveying path 118 on the downstream in the sheet conveying direction of the sheet feed tray 102. The reading unit 106 includes, for example, a reading unit such as a CCD (Charge Coupled Device) scanner, a CMOS sensor, or the like. The reading unit 106 is configured by two reading units which are arranged along the first conveying path 118, and by interposing the conveying path therebetween, and is able to read both sides of images on a conveyed sheet.

The first branching member 124 is present on the downstream side of the reading unit 106 as a switch part. The first branching member 124 switches the conveying direction of the conveyed sheet. The first branching member 124 conveys the sheet which is conveyed from the first conveying path 118 to the second conveying path 120, or the first tray 110. The second conveying path 120 is branched by the first conveying path 118 at a branching point at which the first branching member 124 is arranged. The second conveying path 120 branched by the branching point conveys the sheet to the color erasing unit 108. In addition, the second conveying path 120 joins the first conveying path 118 at a joining point 121 on the upstream of the reading unit 106 in the sheet conveying direction. Accordingly, the second conveying path 120 is able to convey the sheet which is conveyed from the reading unit 106 to the reading unit 106 again through the color erasing unit 108.

The first conveying path 118 includes a second branching member 126 on the downstream of the first branching member 124. The second branching member 126 guides the sheet which is conveyed from the first branching member 124 to the first tray 110, or a third conveying path 122. The third conveying path 122 conveys the sheet to the second tray 112.

The color erasing unit 108 erases color of the image on the conveyed sheet. For example, the color erasing unit 108 erases color of the image which is formed on the sheet using the recording material by heating the sheet up to a predetermined erasing temperature in a state of coming into contact with the conveyed sheet. For example, the color erasing unit 108 of the color erasing apparatus 100 according to the embodiment includes two color erasing units of 108*a* for erasing a first surface, and 108*b* for erasing a second surface of the sheet. The color erasing units 108*a* and 108*b* are arranged so as to face each other by interposing the second conveying path 120 therebetween. The color erasing unit 108*a* heats the sheet by being in contact with the sheet from one side surface of the sheet. The color erasing unit 108*b* heats the sheet by being in contact with the sheet from the other side surface of the sheet. The color erasing unit 108 erases the images on both sides of the sheets to be conveyed by one conveying. The color erasing unit 108 includes temperature sensors 109*a* and 109*b*, respectively, which detect a temperature of a heating unit of the color erasing units 108*a* and 108*b*. The temperature sensors 109*a* and 109*b* may be a contact type, or a non-contact type.

The operation unit 128 which is arranged at the upper side of a main body of the color erasing apparatus 100 includes a touch panel-type display unit, and a variety of operation keys. The operation key includes, for example, a numeric keypad, a stop key, a start key, or the like. A user instructs functional operations of the color erasing apparatus 100 such as a start of the color erasing, reading of the image on the sheet to be erased, or the like, through the operation unit 128. The operation unit 128 displays setting information, an operation status, log information of the color erasing apparatus 100, or a message for a user to be described later.

The discharge rollers 114 and 116 discharge the sheet to the first and second trays 110 and 112 which are vertically arranged at the bottom of the main body. For example, the first tray 110 loads the sheet of which the image thereon is erased, and is reusable. The second tray 112 loads the sheet which is determined as a sheet not reusable. Hereinafter, the first tray 110 is referred to as a reuse tray 110, and the second tray 112 is referred to as a reject tray 112. In addition, the reuse tray 110 and the reject tray 112 are also able to switch a sheet to be received. Setting of respective trays regarding what sheet is to be loaded, that is, setting of sheets regarding conveying destination may be set, for example, from the operation unit 128. Due to this setting, the second branching member 126 switches the conveying path, and guides the conveyed sheet to the first tray 110, or the third conveying path 122.

The conveying path of the sheet is appropriately changed on the basis of a processing mode which is executed by the color erasing apparatus 100. The color erasing apparatus 100 includes a plurality of processing modes. The color erasing apparatus 100 includes, (1) a first color erasing mode in which only the color erasing processing is performed without performing image reading, (2) a second color erasing mode in which the color erasing processing is performed after performing the image reading, (3) a third color erasing mode in which whether or not a sheet p is reusable after the color erasing processing is determined (separation processing), without performing the reading processing which is performed before the color erasing processing, (4) a fourth color erasing mode in which the color erasing processing is performed after reading the image, and further the separation processing is performed, and (5) a reading mode in which the image reading processing is performed without performing the color erasing of the image. The above described each mode can be selected in the operation unit 128 of the color erasing apparatus 100. In addition, a selection of each processing mode may be set from an external terminal without being limited to the operation unit 128 of the color erasing apparatus 100. In the first to fourth color erasing modes, the sheet is necessarily conveyed to the color erasing unit 108. On the other hand, in the reading mode, the color erasing apparatus 100 discharges the sheet through a reading unit 106 by controlling the first branching member 124 without conveying to the color erasing unit 108.

Figure 2:
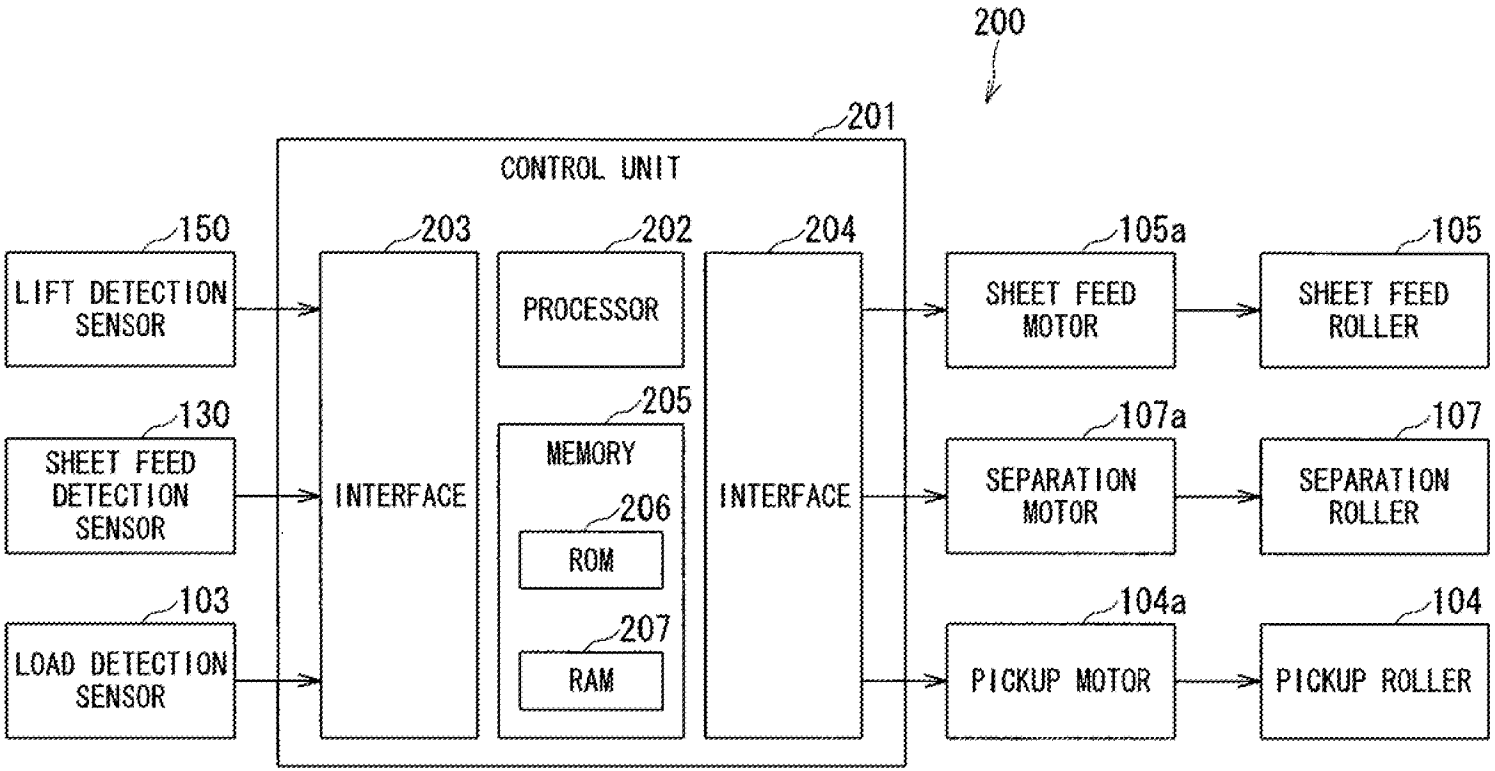
FIG. 2 is a block diagram which shows a hardware configuration of a sheet feed unit.

FIG. 2 is a block diagram which shows an example of a hardware configuration of especially the sheet feed unit 200 among the configurations of the color erasing apparatus 100. The sheet feed unit 200 includes a control unit 201 which controls a start, or stop of sheet feeding. The control unit 201 includes a processor 202, a memory 205 including a ROM 206 and a RAM 207, and interfaces 203 and 204. The control of the start, or stop of the sheet feeding is performed by the processor 202 which executes a program which is stored in the memory 205. Functions of software processing which are executed by the program and the processor 202 may be executed by hardware processing such as an ASIC, or by appropriately combining the software processing and the hardware processing.

As described above, the sheet feed unit 200 includes the pickup roller 104, the sheet feed roller 105, the separation roller 107 for sending the sheet which is loaded in the sheet feed tray 102 one by one into the apparatus, and these units are respectively driven by a pickup motor 104*a*, a sheet feed motor 105*a*, and a separation motor 107*a*. The pickup motor 104*a*, the sheet feed motor 105*a*, and the separation motor 107*a* are connected to the control unit 201 through the interface 204.

In addition, the above described lift detection sensor 150, the sheet feed detection sensor 130, and the load detection sensor 103 are connected to the control unit 201 through the interface 203.

Figure 3:
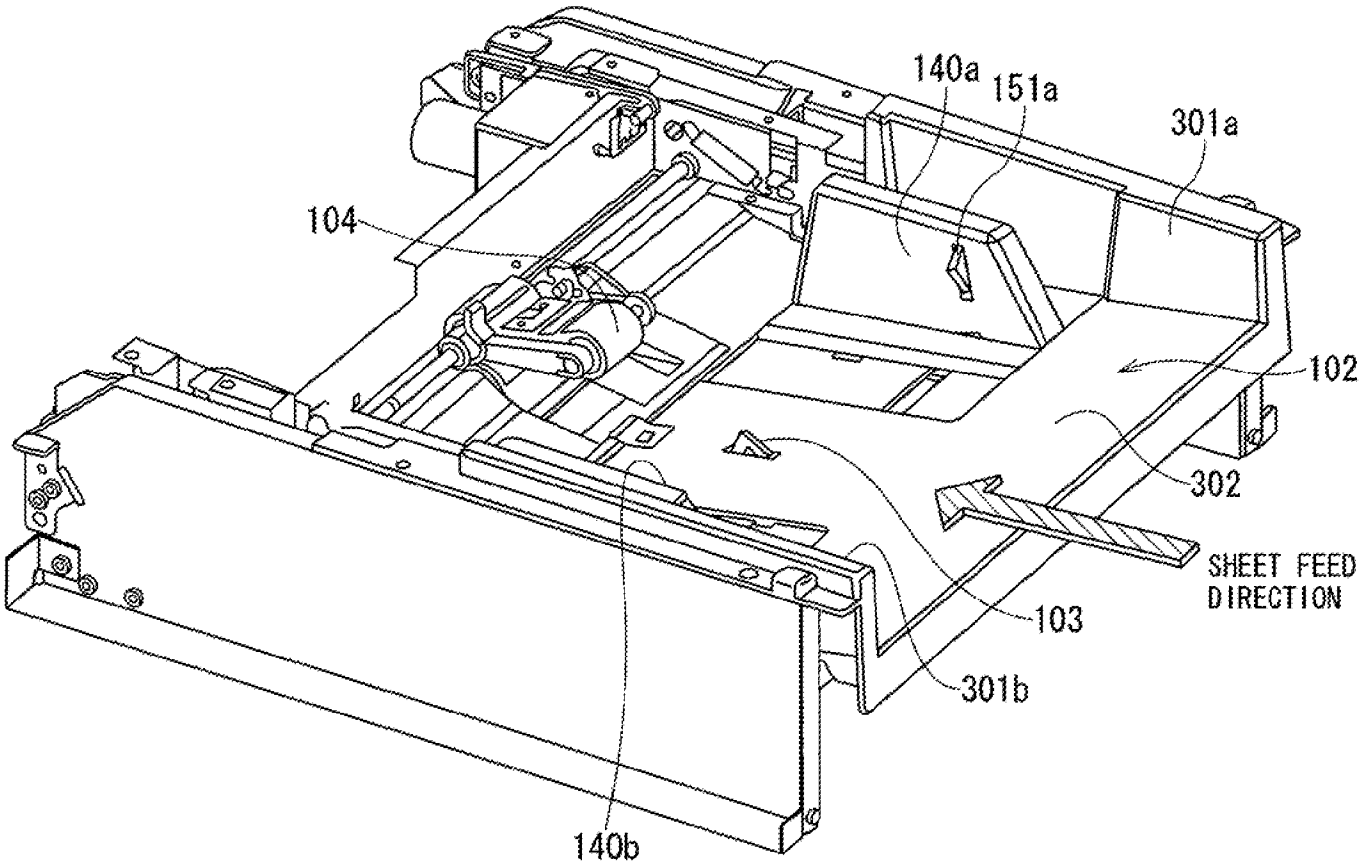
FIGS. 3 and 4 are external perspective views which show example constructions of the sheet feed unit.
Figure 4:
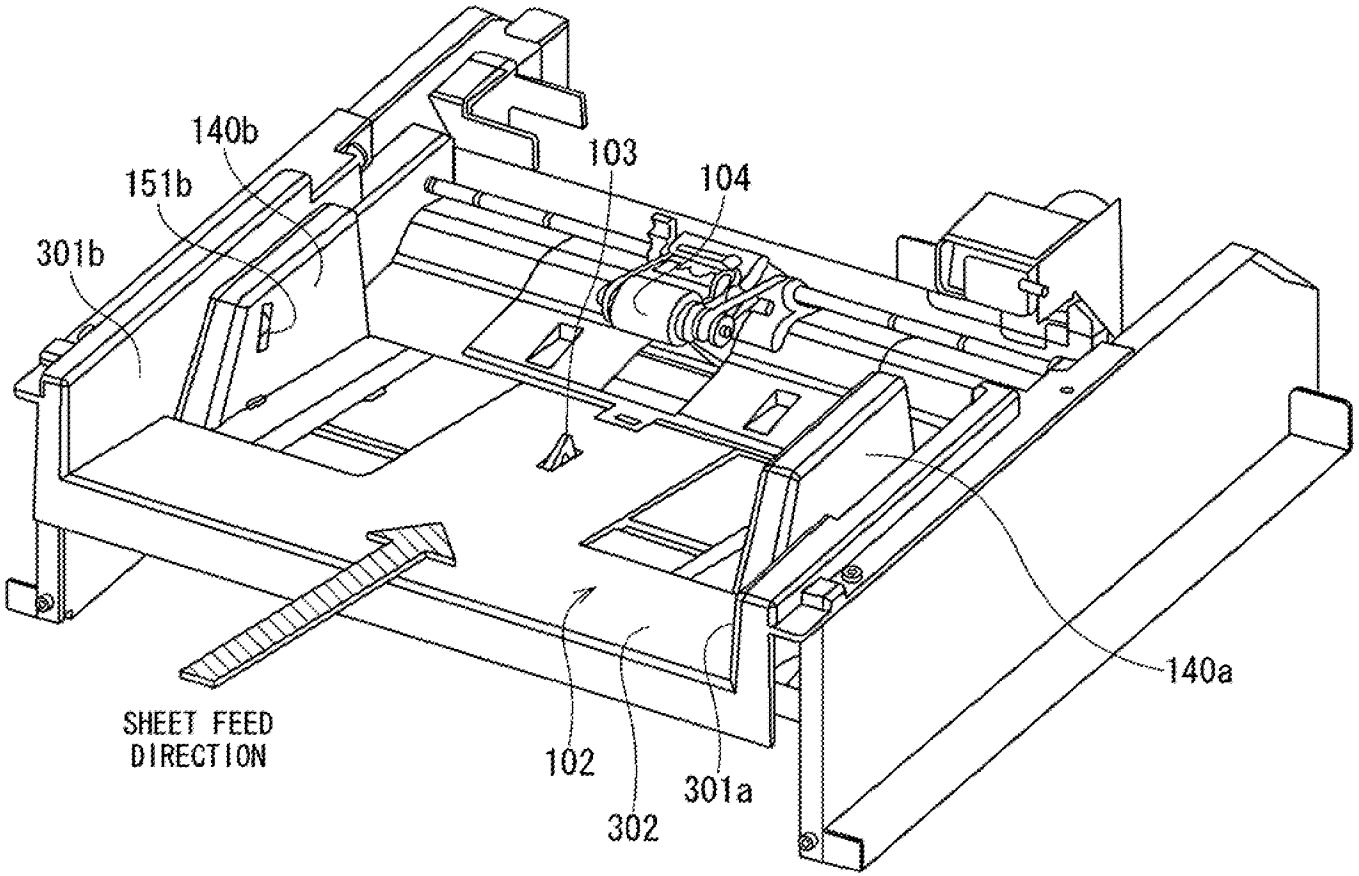

FIGS. 3 and 4 are external perspective views which show constructional examples of the sheet feed unit 200 when seen from separate angles, respectively.

The sheet feed unit 200 includes the sheet feed tray 102 in which a plurality of sheets is loaded in piles. In addition, the sheet feed tray 102 is configured by the left and right side walls 301*a* and 301*b*, and a base plate 302. Respective thick arrows in FIGS. 3 and 4 show the sheet feed direction of the sheet loaded in the sheet feed tray 102. An opening is formed at the substantially center of the base plate 302, and a part of a lever of the load detection sensor 103 is exposed from the opening. When the sheet is loaded in the sheet feed tray 102, the lever of the load detection sensor 103 sinks due to the weight of the sheet. Due to the change in motion of the lever, the load detection sensor 103 detects whether or not the sheet is loaded in the loading surface (base plate 302) of the sheet feed tray 102.

In addition, the regulating members 140*a* and 140*b* for regulating the position of the loaded sheet in the width direction (direction orthogonal to the sheet feed direction) are provided in the sheet feed unit 200. The regulating members 140*a* and 140*b* are configured so as to be movable in the width direction. It is possible to perform a regulation of the sheet in the width direction by causing the regulating members 140*a* and 140*b* to move, and to press the side end portion of the sheet with respect to the sheet which is loaded in the sheet feed tray 102. That is, it is possible to locate the position of the sheet in the width direction at the center of the sheet feed tray 102, and to align the width direction of the plurality of sheets.

The pickup roller 104 is provided at the forward center of the sheet feed tray 102 in the sheet feed direction. The sheet feed roller 105, the separation roller 107, and the sheet feed detection sensor 130 are located further forward of the pickup roller 104 in the sheet feed direction.

Using the pickup roller 104, the sheet feed roller 105, and the separation roller 107, the plurality of sheets (sheet bundle) which is loaded in the sheet feed tray 102 is taken into the color erasing apparatus 100 sequentially, one by one from the top.

Figure 5A:
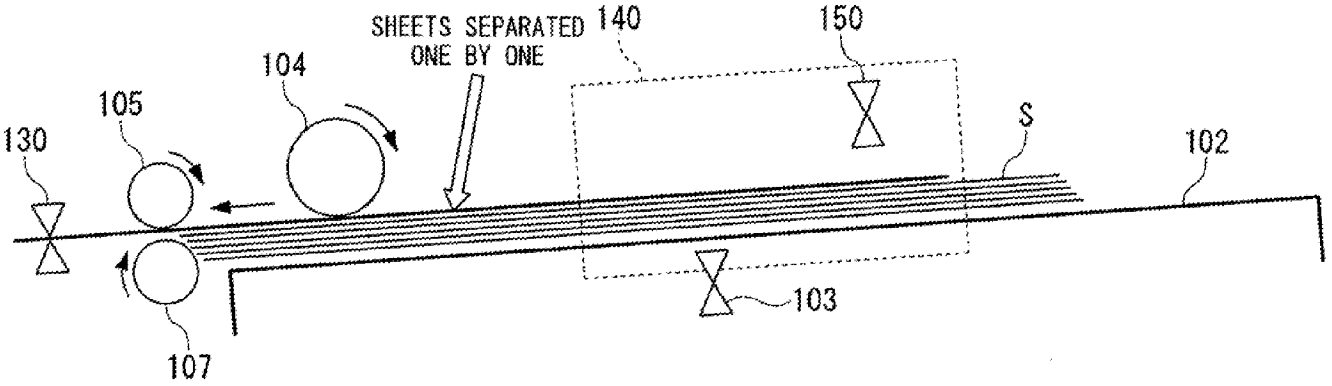
FIG. 5A is a diagram which describes an operation of appropriate sheets which are separated one by one.

FIG. 5A is a diagram which schematically shows a motion of the appropriate sheets, that is, the sheets which are loaded one by one, by being separated without being bound are taken into the apparatus using the pickup roller 104, the sheet feed roller 105, and the separation roller 107. As shown in FIG. 5A, when sheet feeding is started, the pickup roller 104 starts to rotate, and comes into contact with the upper surface of the sheet bundle, and sends the sheet bundle into a nip between the sheet feed roller 105 and the separation roller 107 which is present in front thereof in the sheet feed direction.

The rotation direction of the sheet feed roller 105 is the same as that of the pickup roller 104, and the one sheet on the top face of the sheet bundle is sent further to the forward in the sheet feed direction. In contrast to this, the rotation direction of the separation roller 107 is opposite to the rotation direction of the sheet feed roller 105, and the separation roller 107 operates so as to push back the sheet bundle in the opposite direction to the sheet feed direction. As a result, only the sheet on the top of the sheet bundle is separated, and is taken into the apparatus.

Figure 5B:
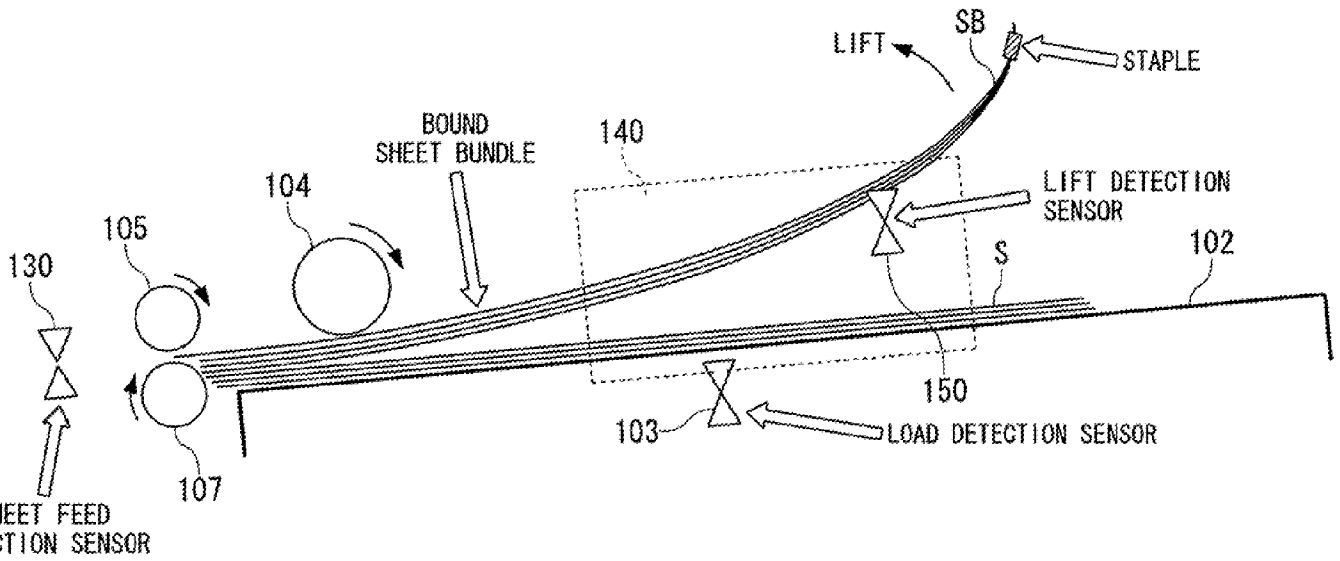
FIG. 5B is a diagram which describes a "lift" of a sheet bundle which occurs when an inappropriately bound sheet bundle is fed.

By contrast, FIG. 5B is a diagram which schematically shows a behavior of the inappropriate sheets which is caused by the motions of the above described pickup roller 104, the sheet feed roller 105, and the separation roller 107. Here, the term "inappropriate sheets" means the sheet bundle in which the plurality of sheets is bound by the staple, the clip, the glue, or the like. It is usually assumed that sheets which are separated one by one are loaded in the sheet feed tray 102 of the sheet feed apparatus such as the color erasing apparatus 100. However, bound sheet bundle may be loaded in the sheet feed tray 102 due to a mistake or the like of a user. In addition, the bound sheet bundle may be loaded by being mixed in other sheets which are not bounded.

FIG. 5B is a diagram which describes a state of the "lift" of the sheet bundle. The "lift" occurs when the sheet bundle of which the rear portion (the rear portion of the sheet bundle in the sheet feed direction) is bound by the staple, the clip, the glue, or the like is about to taken into the apparatus by the sheet feed unit 200.

As described above, the sheet feed roller 105 rotates so that the sheet on the top of the sheet bundle is sent into the apparatus, while the separation roller 107 rotates so that the plurality of sheets other than the top sheet are pushed back in the direction opposite to the sheet feed direction. In the meanwhile, in the bound sheet bundle, all of sheets are fixed to the bound portion. For this reason, the sheet bundle shows a motion of lift in a state of being curved upward from the sheet feed tray 102 by the respective rotational forces of the sheet feed roller 105 and the separation roller 107 in the opposite direction. As mentioned above, this motion of the sheet bundle is referred to as the "lift" of the sheet bundle. Such "lift" may occur even in a sheet bundle bound at a portion of the side thereof.

As described above, it is assumed that the sheet is sent into the apparatus one by one in the sheet feed apparatus such as the color erasing apparatus 100. Thus, when the bound sheet bundle is sent into the apparatus, there may be a problem in that paper jam occurs, or a part of the inside of the apparatus is damaged. Therefore, the color erasing apparatus 100 (sheet feed apparatus) according to the embodiment is configured to detect the "lift", which occurs when the bound sheet bundle is about to taken into the apparatus, by using the lift detection sensor 150, and when the lift is detected, the sheet feeding is immediately stopped, accordingly, the paper jam, or the damage of the apparatus is prevented in advance.

Figure 6:
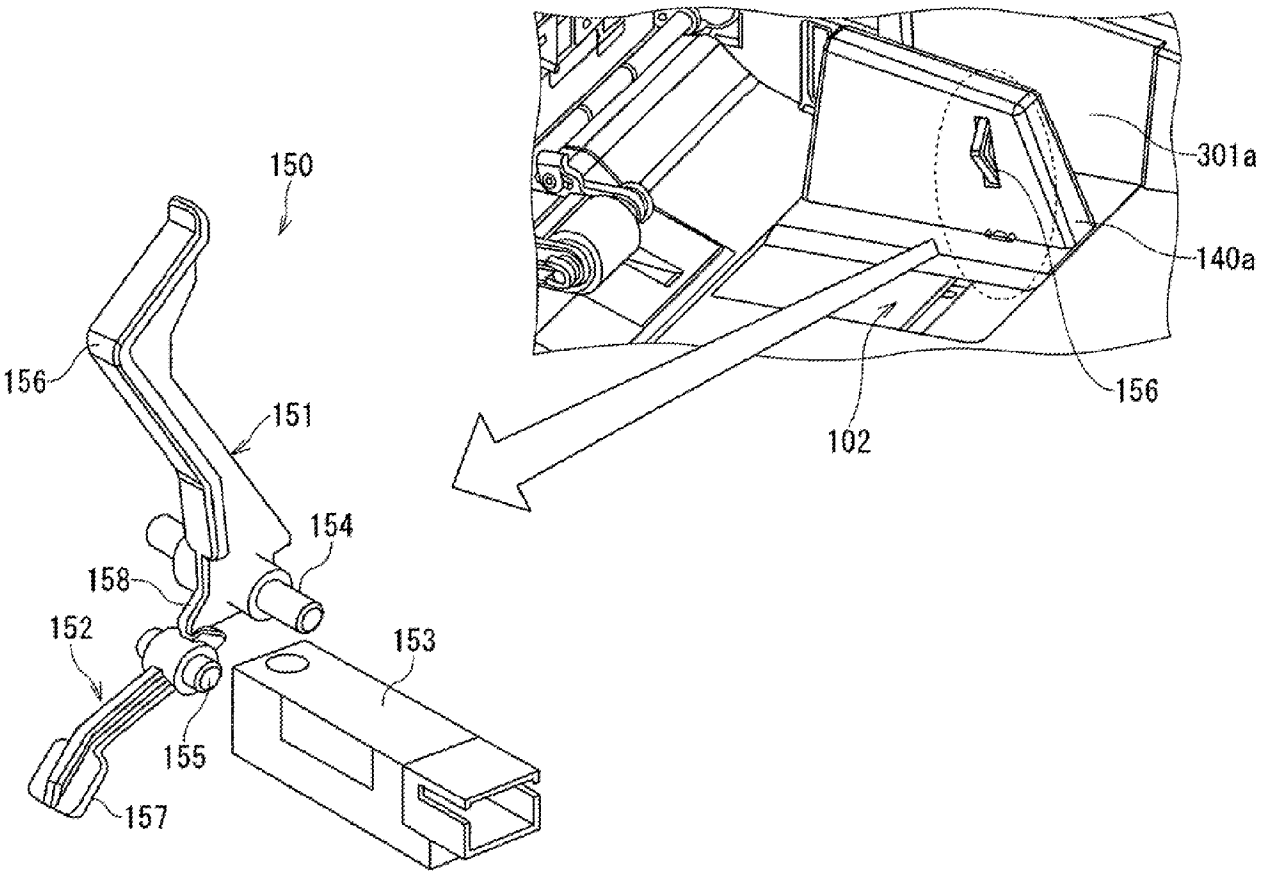
FIGS. 6 and 7 are diagrams which show constructional examples of a lift detection sensor.
Figure 7:
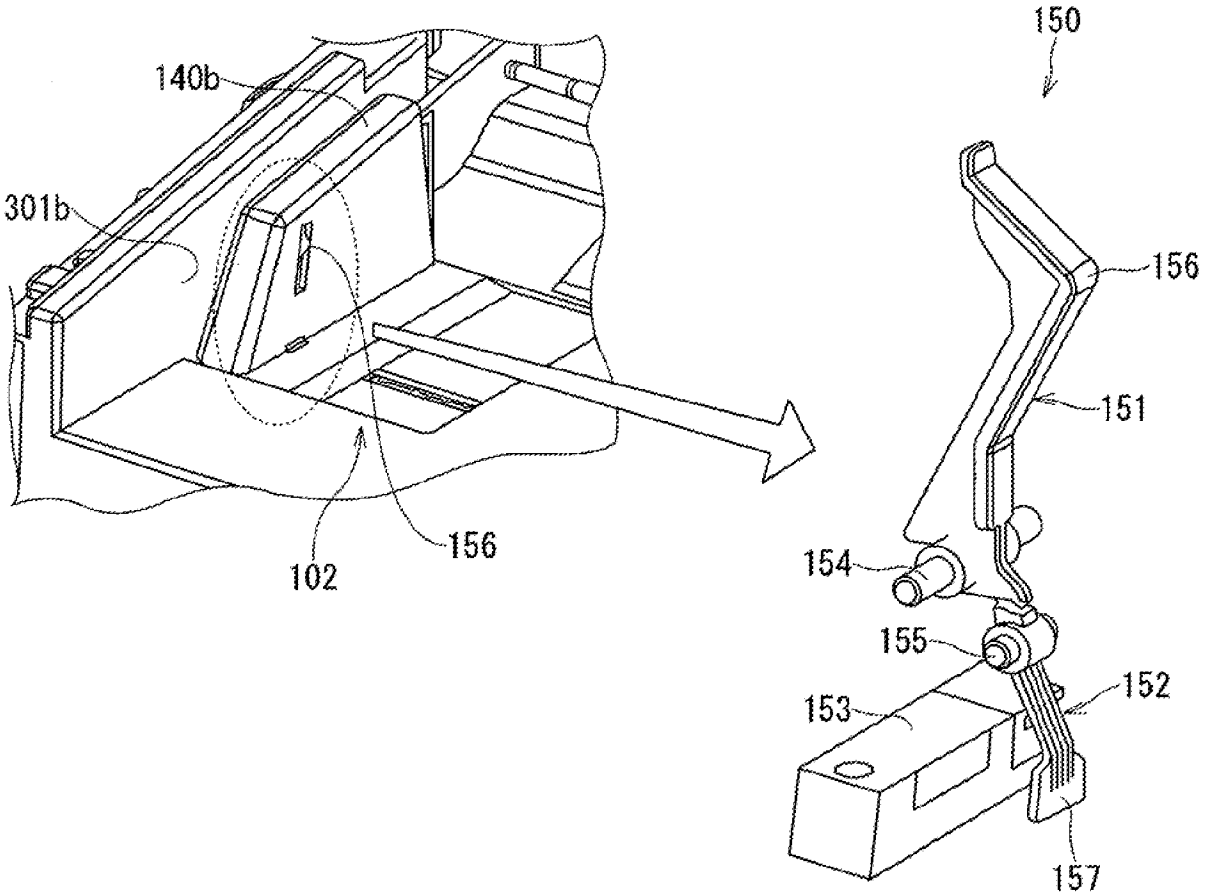

As shown in FIG. 3 and FIG. 4, the lift detection sensors 150 are arranged at the side of the sheet bundle in the width direction, that is, in the vicinity of both side edges of the sheet bundle as the direction which is orthogonal to the sheet feed direction one by one, respectively, on the left and right. In addition, the detection sensors are arranged at a backward position with respect to the center of the sheet bundle, which is loaded in the sheet feed tray 102, in the sheet feed direction FIGS. 6 and 7 are diagrams which show schematic structures of the lift detection sensors 150 according to the embodiment. The lift detection sensor 150 shown on the left below in FIG. 6 is arranged on the right-hand side when seen from the upstream side of the sheet feeding, and the lift detection sensor 150 shown on the left below in FIG. 7 is arranged on the left-hand side when seen from the upstream side of the sheet feeding. Both sensors have the same configuration and structure.

The lift detection sensor 150 includes a first movable lever 151, a second movable lever 152, and a reflection sensor 153. The first and second movable levers 151 and 152 are provided so as to be accommodated in the regulating members (140*a* and 140*b*), and the first and second movable levers 151 and 152 are also moved in the width direction along with the movement of the regulating members 140*a* and 140*b* in the width direction.

The first movable lever 151 is fixed to a first pivot 154, and the first pivot 154 is rotatably supported by the regulating members (140*a* and 140*b*). The first movable lever 151 has an L-shaped curved long arm and a short arm about the first pivot 154. As shown on the upper right in FIG. 6, the curved portion of the long arm is exposed from an opening which is provided at the side of the regulating members (140*a* and 140*b*), and comes into contact with the end portion of the sheet bundle when the bound sheet bundle is lifted. For this reason, the curved portion is referred to as a contact portion 156.

On the other hand, the second movable lever 152 is fixed to a second pivot 155, and the second pivot 155 is also rotatably supported by the regulating members (140*a* and 140*b*) similarly to the first pivot 154. The second movable lever 152 has a short arm, and an arm which is longer than the short arm about the second pivot 155, and a reflective plate 157 is provided at the tip end of the long arm of the second movable lever 152. In addition, the short arm of the second movable lever 152 and the short arm of the first movable lever 151 come into contact in an intermediate contact point 158 due to their respective own weights.

Figure 8B:
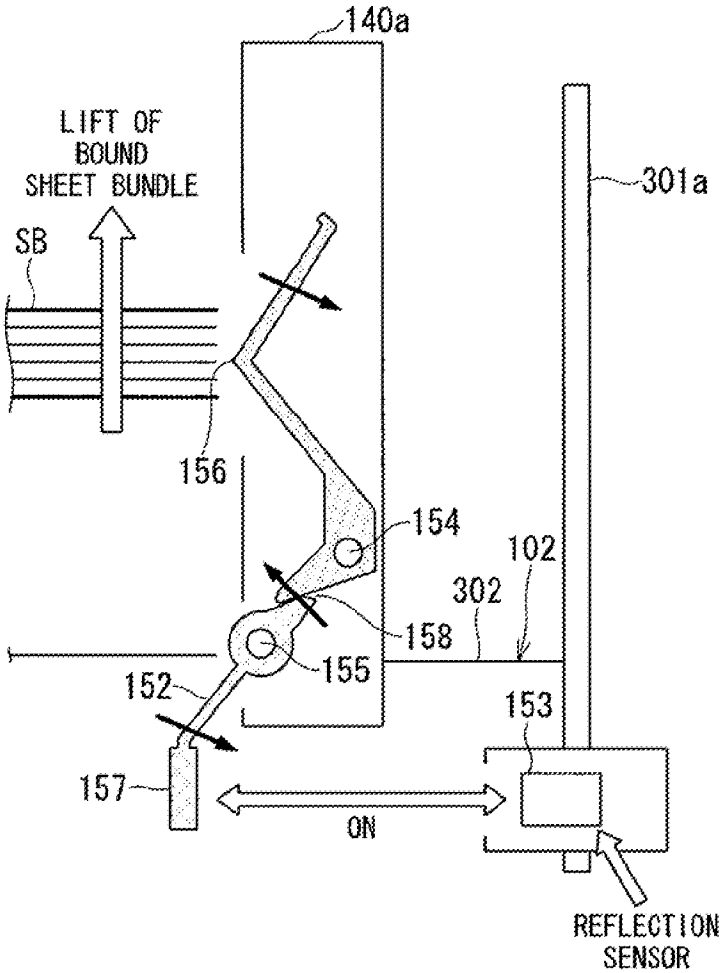
FIGS. 8A and 8B are diagrams which describe motions of a first and second movable levers of the lift detection sensor, and changes in on and off of a reflection sensor due to the motion of the movable lever.
Figure 8A:
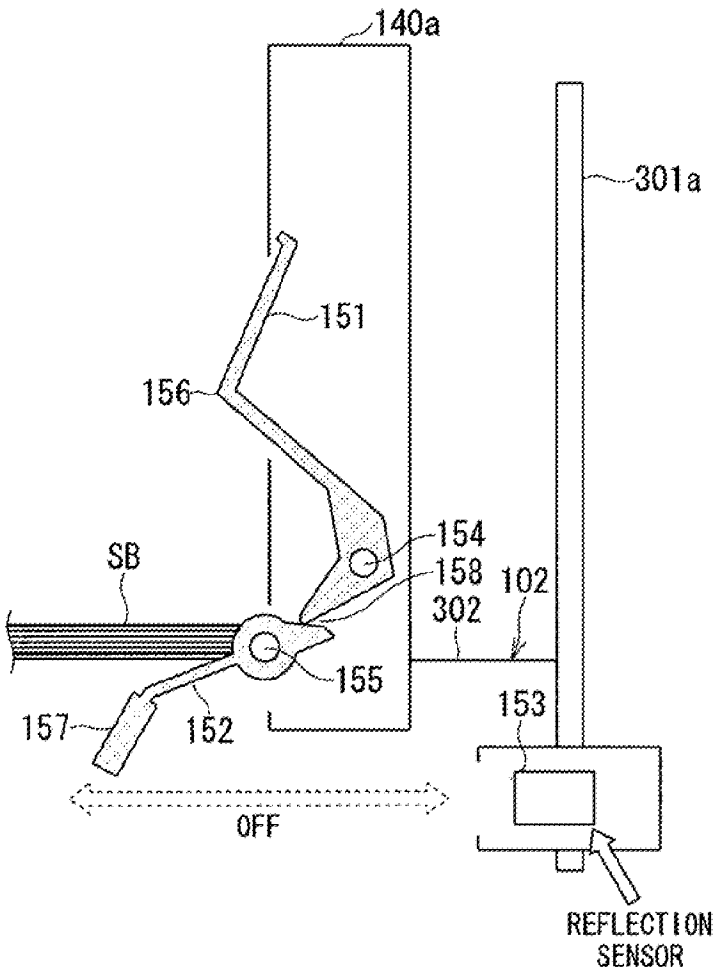

FIGS. 8A and 8B are diagrams which describe the motions of the first movable lever 151 and the second movable lever 152, due to the lift of the bound sheet bundle, and changes in on and off state of the reflection sensor due to the motions. It should be noted that FIGS. 8A and 8B schematically show the lift detection sensor 150 and the regulating member 140*a* which are proved on the right-hand side, and seen from the upstream side in the sheet feed direction.

FIG. 8A shows a state before the sheet feeding of the bound sheet bundle SB, which is loaded in the sheet feed tray 102, is started. At this time, the contact portion 156 of the first movable lever protrudes to the inside of the sheet feed tray 102 from the opening of the regulating member 140*a*.

As shown in FIGS. 8A and 8B, the reflection sensor 153 is arranged at the lower side of the sheet feed tray 102. More specifically, the reflection sensor 153 is arranged at a position which is in the vicinity of the lower part of the side wall 301*a* of the sheet feed tray 102, and is blocked by the base plate 302 from the loading surface of the sheet feed tray 102. Outgoing beams from the reflection sensor 153 proceed substantially in parallel to the base plate 302 of the sheet feed tray 102.

Meanwhile, as shown in FIG. 8A, the reflective plate 157 at the tip end of the second movable lever 152 is lifted upward before the bound sheet bundle SB starts to be fed. For this reason, the outgoing beams from the reflection sensor 153 proceed without being blocked by the reflective plate 157, and thus light amount sufficient to turn on the reflection sensor 153 does not return to the reflection sensor 153. Accordingly, the reflection sensor 153 is turned off in a state in FIG. 8A.

On the other hand, when the sheet feeding of the bound sheet bundle SB is started, the above described "lift" occurs, and the rear end of the bound sheet bundle SB is lifted. At this time, the side end of the bound sheet bundle SB comes into contact with the contact portion 156 of the first movable lever 151. Due to the contact, as shown in FIG. 8B, the first movable lever 151 rotates about the first pivot 154 in the clockwise direction.

As described above, at the intermediate contact point 158, the short arm of the second movable lever 152 and the short arm of the first movable lever 151 come into close contact with each other due to their respective own weighs thereof. Such a contact is kept during the rotation of the first movable lever 151.

Accordingly, when the first movable lever 151 rotates in the clockwise direction about the first pivot 154, the second movable lever 152 rotates in the counter-clockwise direction about the second pivot 155, as shown in FIG. 8B. As a result, the reflective plate 157 at the tip end of the second movable lever 152 descends, and reflects the outgoing beams from the reflection sensor 153 toward the reflection sensor 153. As a result, the reflection sensor 153 is turned on.

It should be noted that the state in FIG. 8A also corresponds to a case where the appropriate sheets which are separated one by one are loaded. That is, when all of the sheets loaded in the sheet feed tray 102 are separated one by one, the reflection sensor 153 is turned off at all times without being turned on. Only when inappropriate sheet bundle SB, in which sheets are bound, is starting to be fed, the lift detection sensor 150 (reflection sensor 153) is turned on.

The reason why two movable levers of the first movable lever 151 and the second movable lever 152 are used as the movable levers is to amplify the motion of the first movable lever 151 using the second movable lever 152. That is, it is to increase a displacement of the reflective plate 152 of the second movable lever 152, even when a displacement of the contact portion 156 of the first movable lever 151 is small. As a result, the reflection sensor 153 is able to detect the presence or absence of the reflected light from the reflective plate 157 with high reliability.

Alternatively, only one movable lever may be used, instead of using two movable levers of the first movable lever 151 and the second movable lever 152.

(1-2) Operation

The operation of the color erasing apparatus 100 (sheet feed apparatus) according to the first embodiment which is configured as described above will be described using the flowchart in FIG. 9, and the timing chart in FIG. 10.

Figure 10:
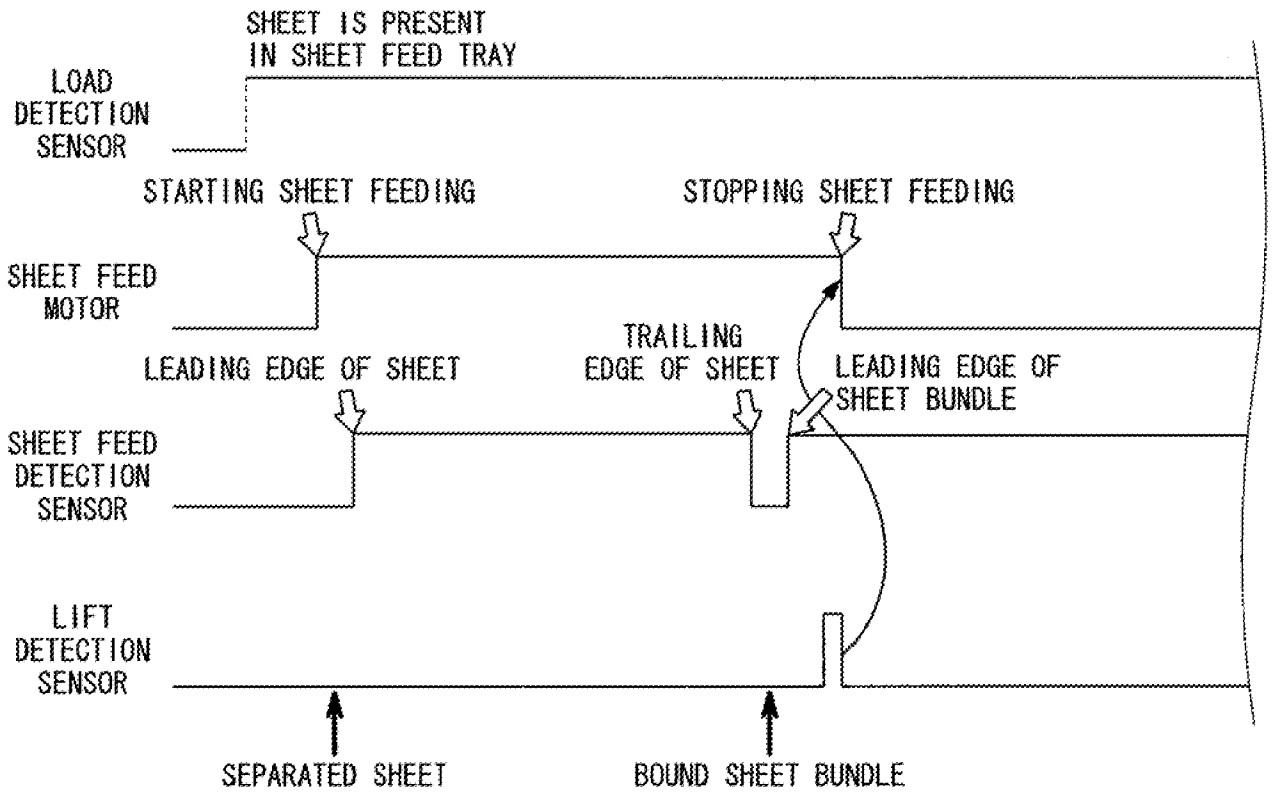
FIG. 10 is a timing chart which shows an operation example of the sheet feed apparatus (color erasing apparatus) according to the first embodiment.

When the sheets are loaded in the sheet feed tray 102, the load detection sensor 103 is turned on, as shown at the top in FIG. 10, and becomes a state which is able to receive a start instruction of sheet feeding.

Figure 9:
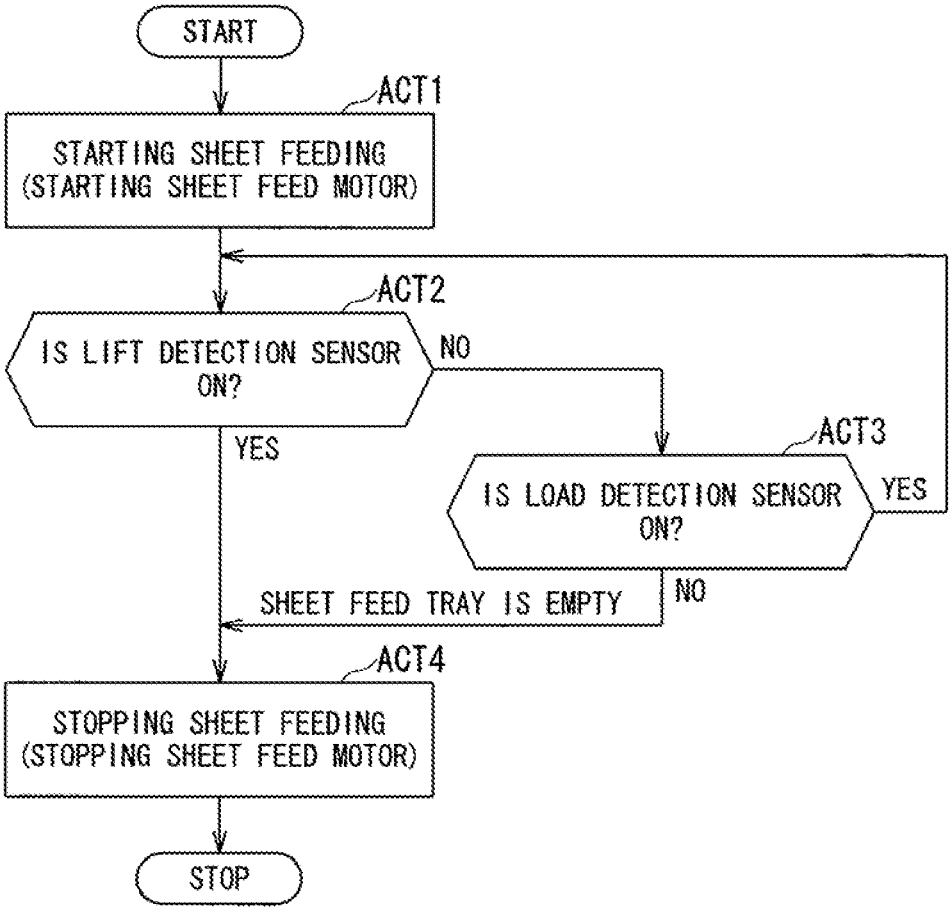
FIG. 9 is a flowchart which shows a processing example of a sheet feed apparatus (color erasing apparatus) according to a first embodiment.

In Act 1 in FIG. 9, when a user instructs the start of sheet feeding, each motor which drives the pickup roller 104, the sheet feed roller 105, the separation roller 107, or the like start rotating. In the second stage in FIG. 10, the rotating state of the sheet feed motor is representatively shown.

When the loaded sheets are appropriate sheets which are separated one by one, the lift detection sensor 150 is not turned on (NO in ACT 2).

The third stage in FIG. 10 shows a state of being turned on, or off of the sheet feed detection sensor 130 which is located in front of the sheet feed roller 105. If the appropriate sheets which are separated one by one are fed, the sensor 130 is turned on when the leading edge of the sheet passes through, and turned off when the trailing edge of the sheet passes through.

In ACT 3, the state of the load detection sensor 103 is determined. As long as the sheets are loaded in the sheet feed tray 102, the load detection sensor 103 is turned on, even when the appropriate sheets which are separated one by one are loaded, or when the inappropriate sheets which are bound are loaded.

When the sheets loaded in the sheet feed tray 102 are the appropriate sheets which are all separated one by one, the process returns to ACT 2 passing the pass YES in ACT 3 from NO in ACT 2, and repeats this process until the load detection sensor 103 is turned off. When the load detection sensor 103 is turned off (NO in ACT 3), that is, all of the sheet feeding is completed, the process proceeds to ACT 4, and the sheet feeding is stopped.

On the other hand, when the sheet feeding is started with respect to an inappropriate sheet bundle which is bound, only a sheet on the top of the sheet bundle is sent, and the leading edge thereof is detected by the sheet feed detection sensor 130. In this case, however, the above described "lift" occurs in the sheet bundle, and the lift detection sensor 150 is turned on (YES in ACT 2 in FIG. 9, and the fourth stage in FIG. 9). When the on signal is received from the lift detection sensor 150, the control unit 201 immediately stops the sheet feeding by stopping the sheet feed motor or the like (ACT 4).

As described above, it is possible to detect the "lift" of the bound sheet bundle using the lift detection sensor 150, and to stop sheet feeding of the bound sheet bundle using the color erasing apparatus 100 (sheet feed apparatus) according to the first embodiment, the paper jam, or the damage in the apparatus can be prevented in advance.

When the bound sheet bundle is drawn into the sheet feed roller 105 or the like, the "lift" is usually started from the trailing edge of the sheet bundle. In the color erasing apparatus 100 according to the first embodiment, the lift detection sensor 150 is provided at a backward position with respect to the center of the sheet bundle in the sheet feed direction. Therefore, it is possible to detect the "lift" in an earlier stage, and to stop the sheet feeding before the sheet bundle is sent into the apparatus, when the "lift" occurs.

In addition, the lift detection sensor 150 according to the embodiment is basically configured by a mechanical sensor having a movable lever. Thus, the movable lever is not affected by the paper dust which is generated due to rubbing of sheets, or the like. In addition, the motion of the movable lever is detected using the reflection sensor 153 which is arranged at the lower part of the base plate 302 of the sheet feed tray 102. In addition, since the paper dust is blocked in the base plate 302, and does not reach the reflection sensor 153. For this reason, a detection performance of the lift detection sensor 150 according to the embodiment does not deteriorate due to the paper dust. Further, since the external light such as the westering light does not reach the reflection sensor 153 at the lower part of the base plate 302, a malfunction due to the external light does not occur, as well.

In addition, the movable lever of the lift detection sensor 150 according to the embodiment is accommodated in the regulating member (140*a* and 140*b*), and the movable lever is configured so as to move in the width direction of the sheet in conjunction with the motion of the regulating member (140*a* and 140*b*). Therefore, even with respect to the sheet with the different width, the movable lever is arranged adjacent to the side end portion of the sheet bundle at all times, accordingly, it is possible to reliably detect the lift of the sheet bundle.

Furthermore, by configuring the movable lever with two movable levers, it is possible to amplify the motion of the movable lever due to the contact with the sheet bundle. As a result, it is possible to enhance the accuracy of the lift detection.

(2) Second Embodiment

There may be a case where a user inserts additional sheets to the piled sheets which are loaded in a sheet feed tray 102 while sheet feeding is continued. In sheet feeding, since a sheet is taken into a apparatus from the top of the loaded sheets, when adding the sheet, it is assumed that a user lifts up a sheet bundle which is loaded in the sheet feed tray 102, and inserts sheets to be added from the bottom of the sheet bundle. When the sheet is added in this manner, since the user lifts up the sheet bundle from the sheet feed tray 102, even when the loaded sheets are appropriate sheets which are all separated one by one, a lift detection sensor 150 is turned on. Since this "ON" is caused simply by the user operation, not by the "lift" due to the bound sheet bundle, it is not necessary to stop the sheet feeding. Each example according to the second embodiment to be described below includes a means which continues the sheet feeding without stopping the sheet feeding when it is considered that the lift detection sensor 150 is turned on due to the fact that the user lifts up the sheets.

(2-1) First Example of Second Embodiment

According to a first example, a period is limited in which a detection result of the lift detection sensor 150 is used. That is, sheet feeding is stopped when the lift detection sensor 150 detects the lift during a predetermined period after starting the sheet feeding of the loaded sheets. On the other hand, even when the lift is detected after the predetermined period, the sheet feeding is not stopped. More specifically, the sheet feeding is stopped when the lift is detected during a period after the sheet feed detection sensor 130 detects the passing through of the leading edge of the sheet and until the trailing edge of the sheet passes through the position of the lift detection sensor 150, and the sheet feeding is not stopped even when the lift is detected after the period.

Figure 11:
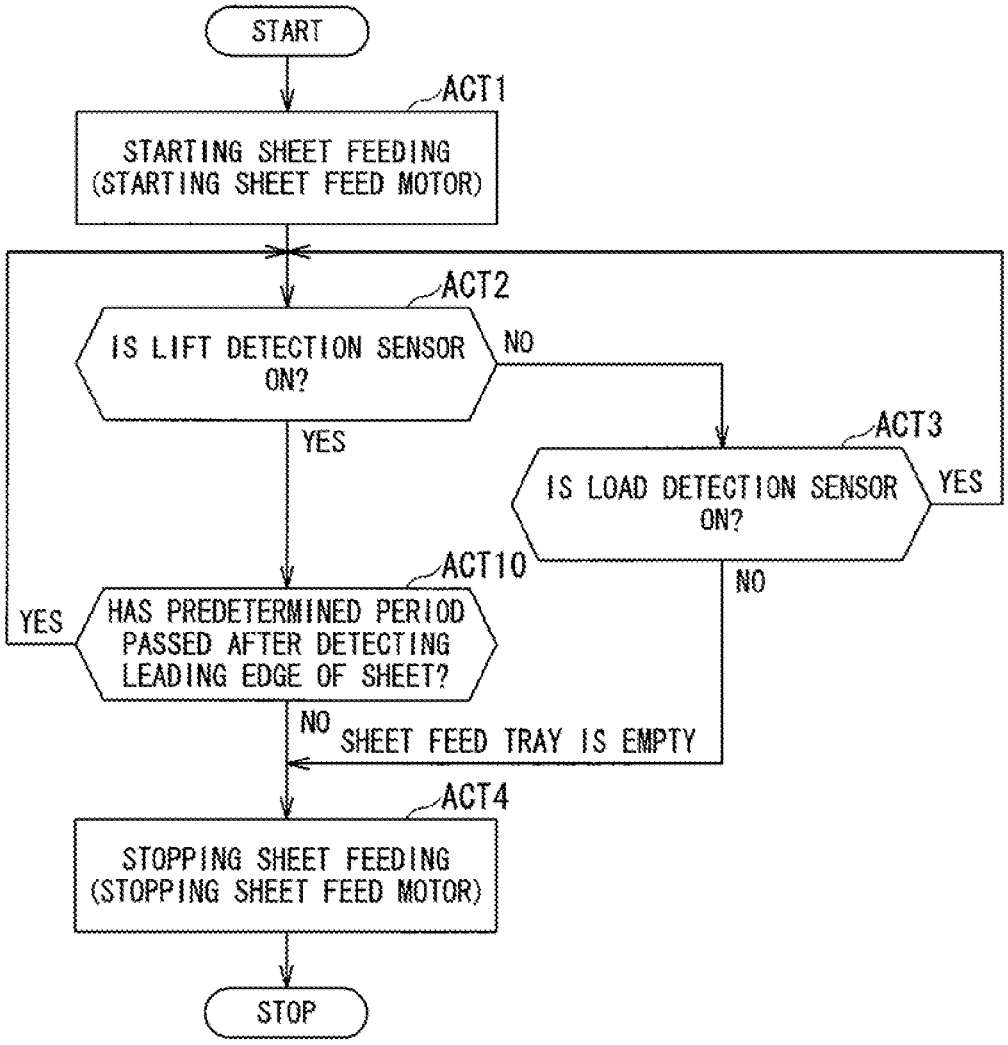
FIG. 11 is a flowchart which shows a processing example of a sheet feed apparatus (color erasing apparatus) according to a second embodiment (a first example)
Figure 12:
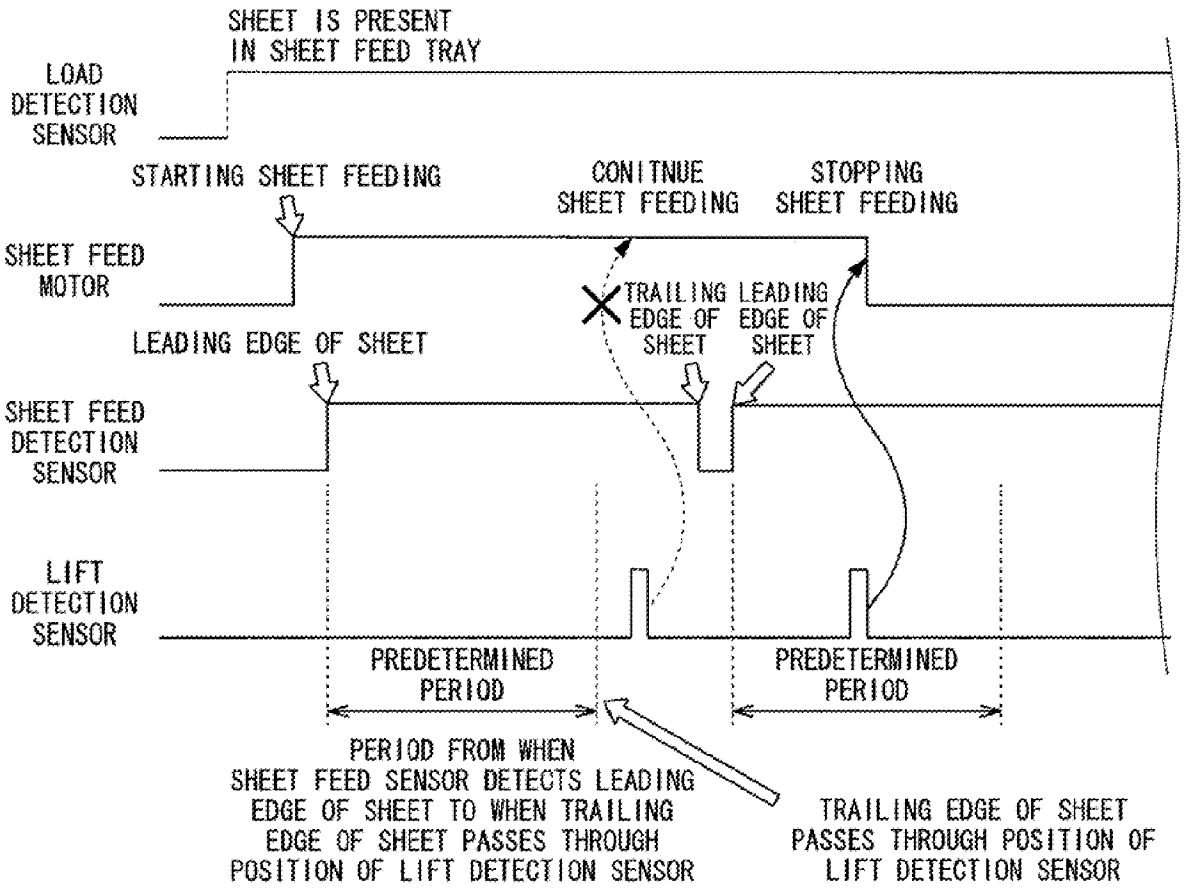
FIG. 12 is a timing chart which shows an operation example of the sheet feed apparatus (color erasing apparatus) according to the first embodiment (a first example)

FIG. 11 is a flowchart which shows an operation example of the first example, and FIG. 12 is a timing chart thereof. Processes in ACTS 1 to 3, and ACT 4 in FIG. 11 are the same as those in the first embodiment, and a difference from the first embodiment is that a determination of whether or not a predetermined period is passed (ACT 10) after detecting the leading edge of the sheet between ACT 2 and ACT 4 is added.

For example, the length of a predetermined period T is able to be obtained in advance from a distance D between the sheet feed detection sensor 130 and the lift detection sensor 150, and sheet feed speed V, as T=D/V. The control unit 201 determines whether or not the predetermined period is passed after detecting the leading edge of the sheet on the basis of the length of the predetermined period T which is obtained in advance.

During the above described period T, the lift of the bound sheet bundle is detected by being sent after detecting the leading edge of the sheet on the top of the sheet bundle.

Accordingly, for the case in which when the lift detection sensor 150 is turned on, the above described period T has passed (YES in ACT 10), it is considered that the lift detection sensor 150 is turned on as a result of a user consciously lifted the sheet bundle from the sheet feed tray 102, not as the lift which occurs when the bound sheet bundle is sent. Therefore, in this case, the process returns to ACT2, and processing is continued without stopping the sheet feeding (corresponding to a first detection signal of the lift detection sensor 150 in FIG. 12).

In contrast to this, for the case in which when the lift detection sensor 150 is turned on, the above described period T has not passed (NO in ACT 10), it is considered that the lift detection sensor 150 is turned on by the lift which occurs when the bound sheet bundle is sent. Accordingly, in this case, the process proceeds to ACT 4, and the sheet feeding is stopped (corresponding to a second detection signal of the lift detection sensor 150 in FIG. 12).

(2-2) Second Example of Second Embodiment

In a second example, if the lift detection sensor 150 has already detected the lift at a time when feeding the sheets loaded in the sheet feed tray 102 are started, then, the sheet feeding is continued without stopping the sheet feeding.

Figure 13:
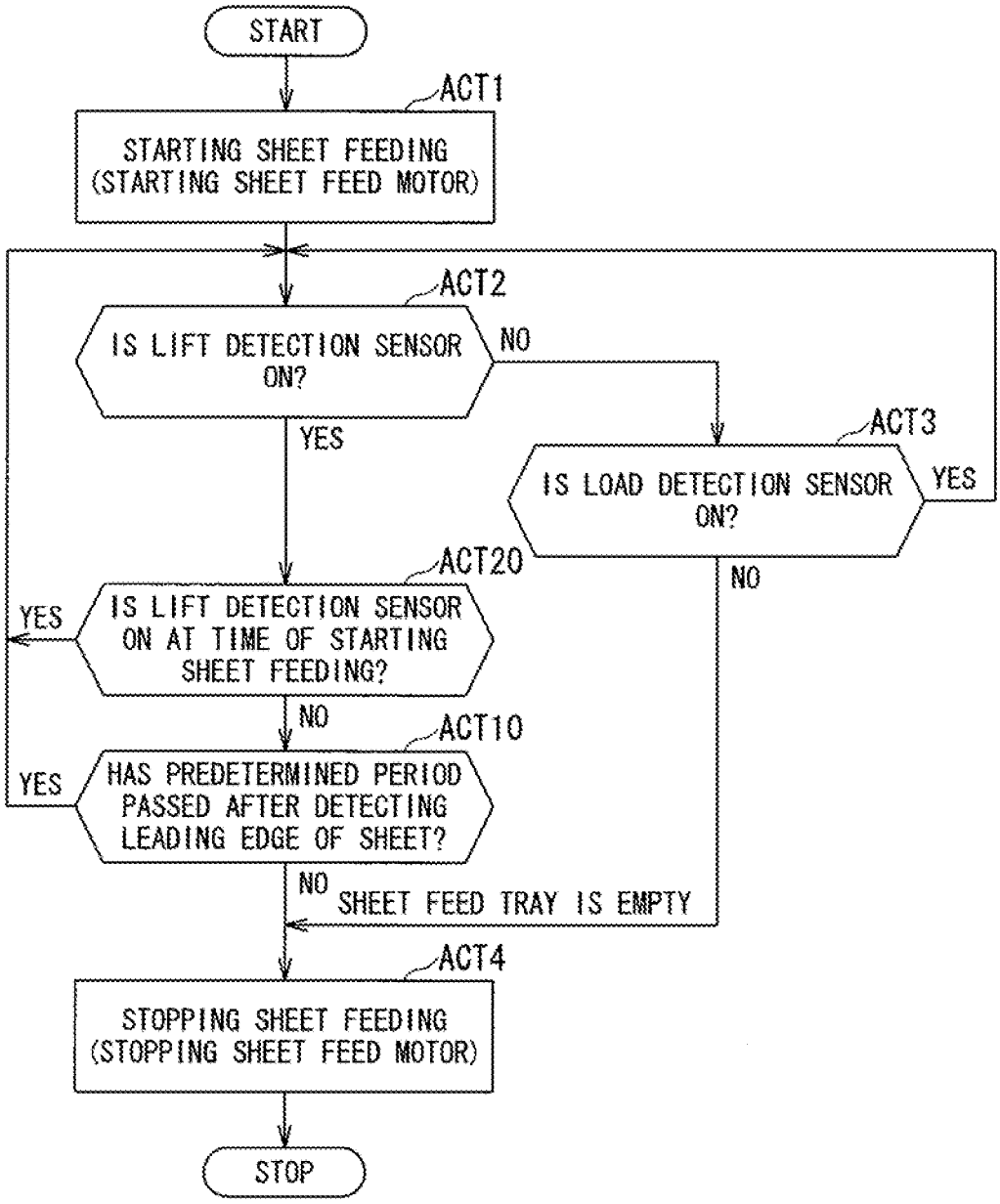
FIG. 13 is a flowchart which shows a processing example of the sheet feed apparatus (color erasing apparatus) according to the second embodiment (a second example)
Figure 14:
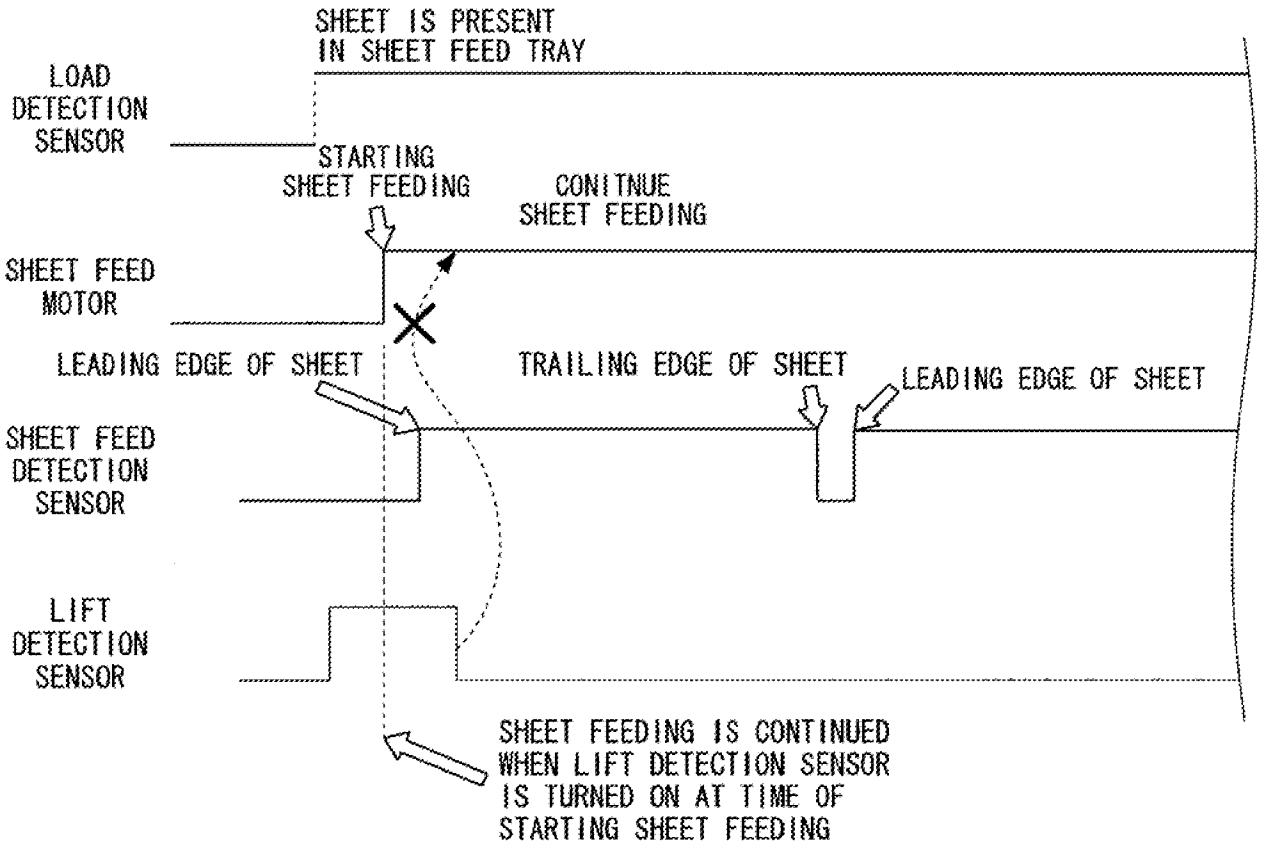
FIG. 14 is a timing chart which shows an operation example of the sheet feed apparatus (color erasing apparatus) according to the first embodiment (a second example)

FIG. 13 is a flowchart which shows an operation example of the second example, and FIG. 14 is a timing chart thereof. Processes in ACTs 1 to 3, and ACTs 10 and 4 in FIG. 13 are the same as those in the first example, and a difference from the first example is that a determination of whether or not the lift detection sensor 150 is turned on in advance at the time of starting the sheet feeding (ACT 20) is added between ACT 2 and ACT 10.

It is naturally after the start of sheet feeding that the lift of the bound sheet bundle occurs. Accordingly, if the lift detection sensor 150 has already been turned on at the time of starting the sheet feeding (YES in ACT 20), it is not considered as the lift caused by the bound sheet bundle, but as a lift caused by a user who consciously has lifted the sheet bundle from the sheet feed tray 102. Therefore, in this case the process returns to ACT 2, and the processing is continued without stopping the sheet feeding (refer to FIG. 14, as well).

In the process shown in FIG. 13, it is assumed that a determination on ACT 20 is added in addition to ACT 10 of the first example, however, only the determination on ACT 20 may be performed instead of the determination on ACT 10.

(2-3) Third Example of Second Embodiment

A third example is an example in which if the lift detection sensor 150 continuously detects the lift (ON) during a predetermined duration, sheet feeding is not stopped.

Figure 15:
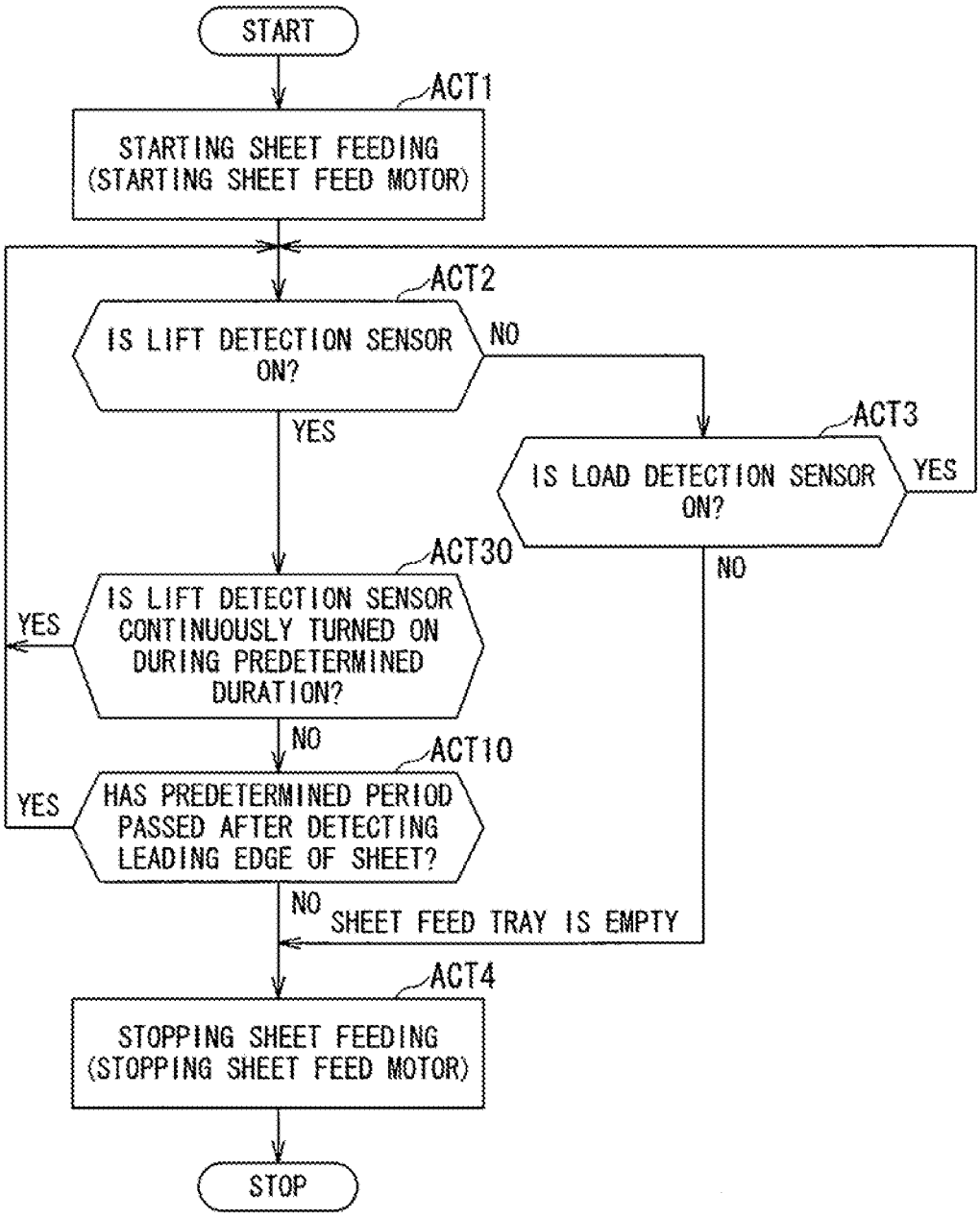
FIG. 15 is a flowchart which shows a processing example of the sheet feed apparatus (color erasing apparatus) according to the second embodiment (a third example)
Figure 16:
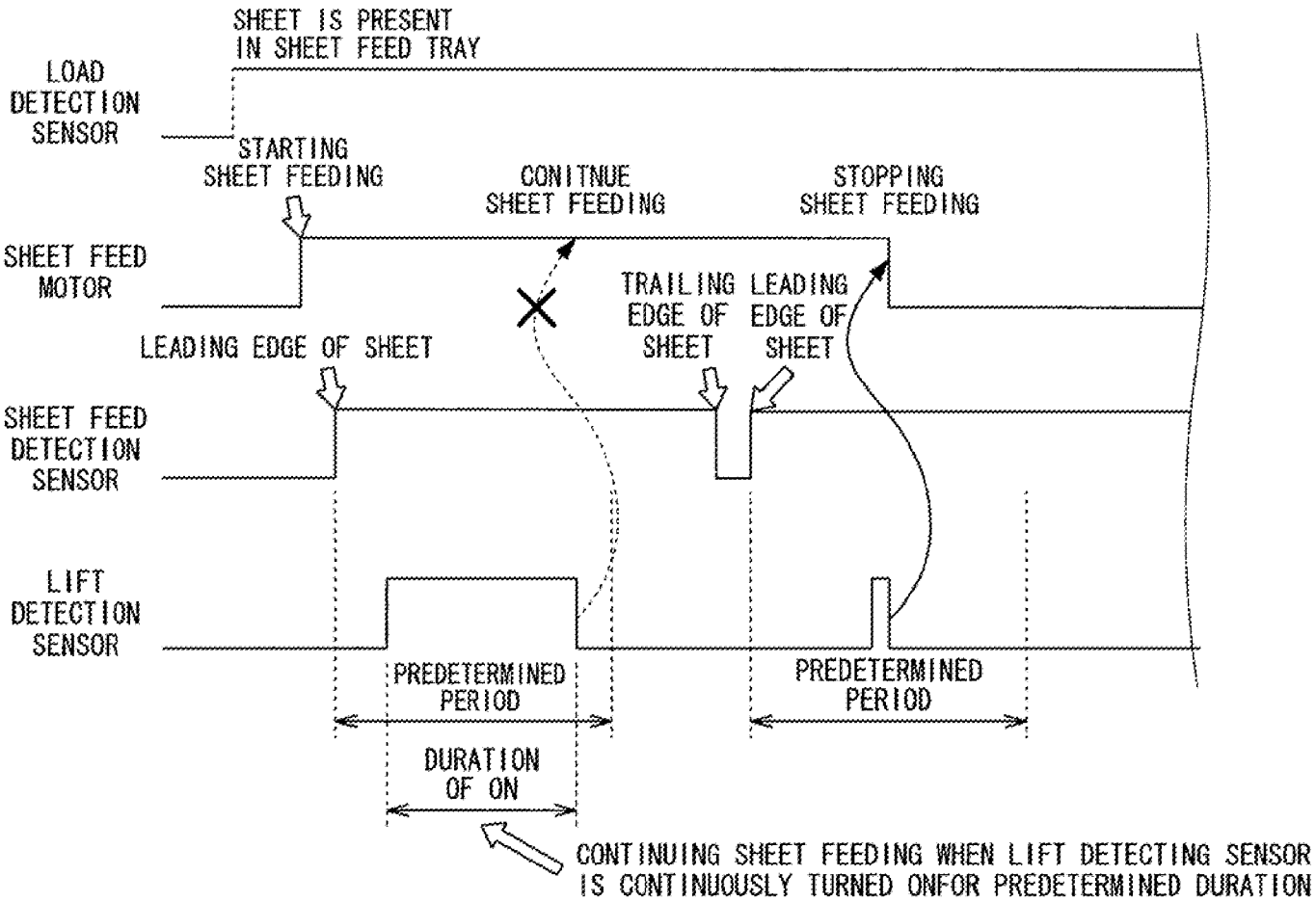
FIG. 16 is a timing chart which shows an operation example of the sheet feed apparatus (color erasing apparatus) according to the first embodiment (a third example)

FIG. 15 is a flowchart which shows an operation example of the third example, and FIG. 16 is a timing chart thereof. Processes in ACTs 1 to 3, and ACTs 10 and 4 in FIG. 15 are the same as those in the first example, and a difference from the first example is that a determination of whether or not the lift detection sensor 150 continuously detects the lift (ON) during a predetermined duration (ACT 30) is added between the ACT 2 and ACT 10.

A time period in which the lift detection sensor 150 is kept to be turned on due to the lift corresponds to a period in which the side-end portion of the sheet bundle passes through a contact portion 156 of a movable lever 151 from bottom to top, and not so much a long period. For example, the duration of time in which the lift detection sensor 150 is continuously tuned on is a short time such as one second. Accordingly, when the lift detection sensor 150 is continuously tuned on over the predetermined duration (YES in ACT 30), it is considered that the lift detection sensor 150 is turned on due to the lift caused by a user who consciously lifts the sheet bundle from the sheet feed tray 102. Therefore, in this case, the process returns to ACT 2, and processing is continued without stopping the sheet feeding (refer to FIG. 16, as well).

In the processing shown in FIG. 15, it is assumed that a determination on ACT 30 is added to ACT 10 of the first example, however, only the determination on ACT 30 may be performed instead of the determination on ACT 10.

(2-4) Fourth Example of Second Embodiment

In fourth example, if the load detection sensor 103 detects that sheets are not loaded in the loading surface of the sheet feed tray 102, that is, if the load detection sensor 103 is turned off when the lift is detected by the lift detection sensor 150, sheet feeding is not stopped.

Figure 17:
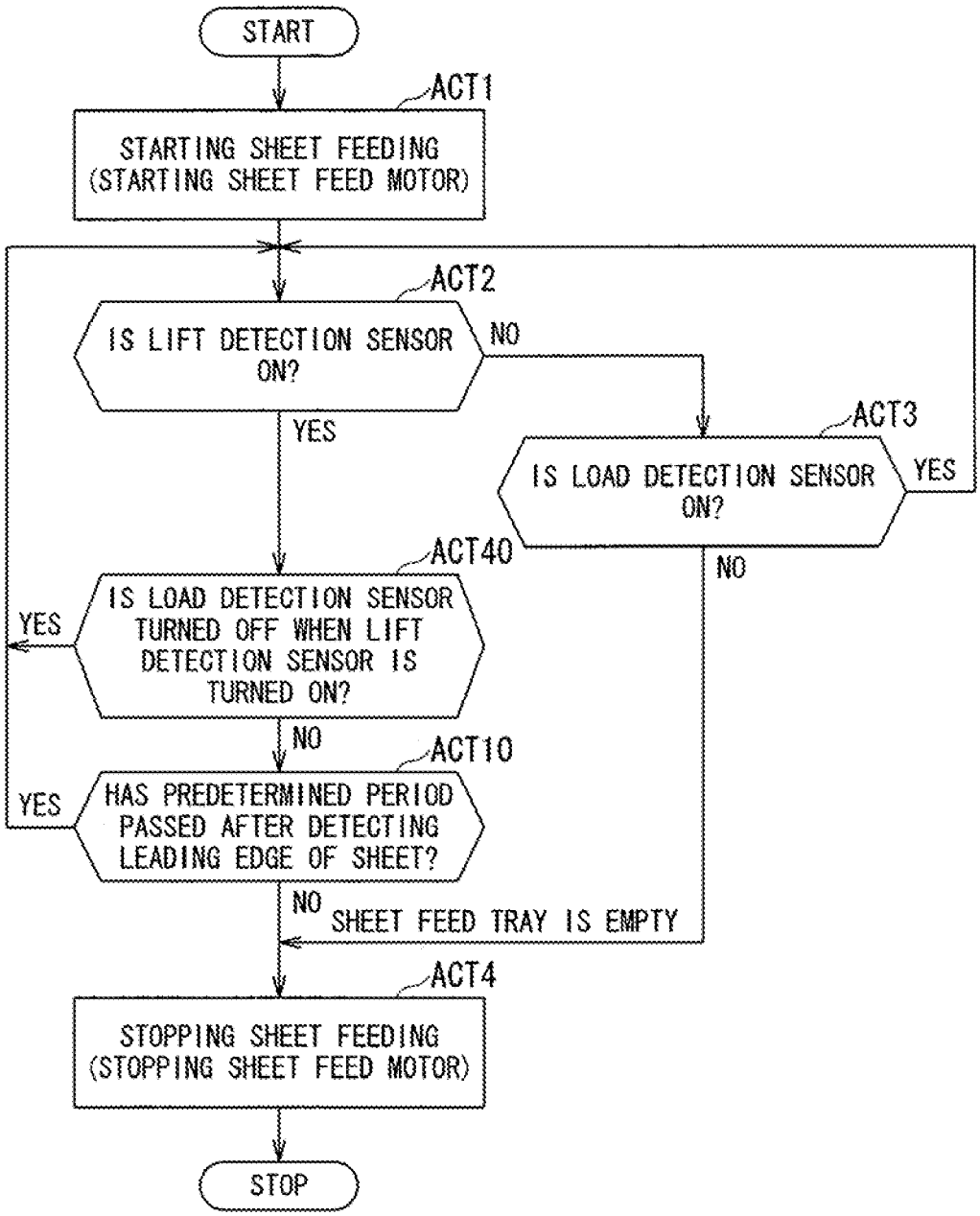
FIG. 17 is a flowchart which shows a processing example of the sheet feed apparatus (color erasing apparatus) according to the second embodiment (a fourth example)
Figure 18:
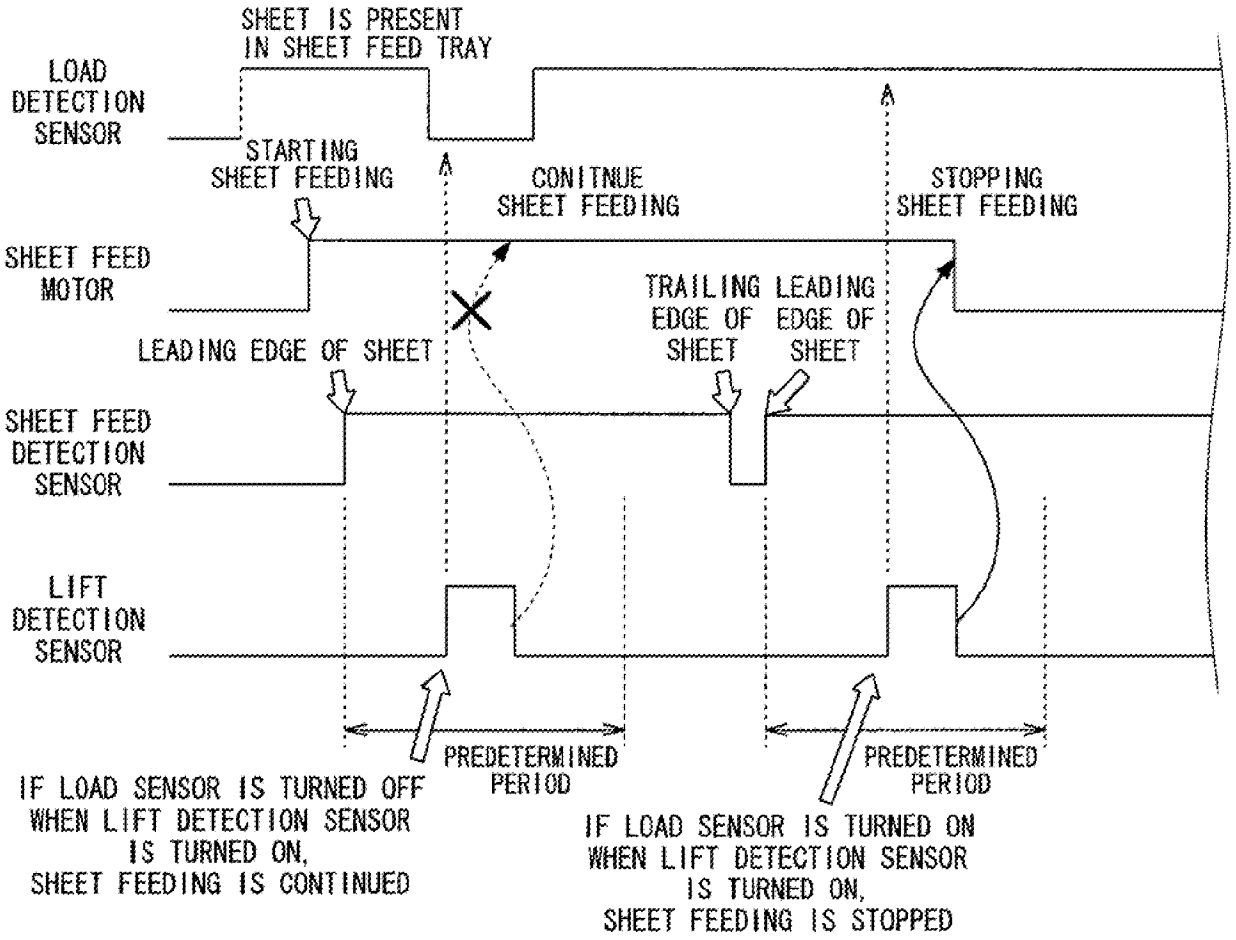
FIG. 18 is a timing chart which shows an operation example of the sheet feed apparatus (color erasing apparatus) according to the first embodiment (a fourth example).

FIG. 17 is a flowchart which shows an operation example in the fourth example, and FIG. 18 is a timing chart thereof. Processes in ACTs 1 to 3, and ACTs 10 and 4 in FIG. 17 are the same as those in the first example, and a difference from the first example is that a determination of whether or not the load detection sensor 103 is turned off (ACT 40) when the lift detection sensor 150 detects the lift is added, between ACT 2 and ACT 10.

When the lift detection sensor 150 detects the lift, and the load detection sensor 103 is turned off, it is considered that the lift detection sensor 150 is turned on due to the lift caused by a user who consciously lifts the sheet bundle from the sheet feed tray 102. Therefore, in this case, the process returns to ACT 2, and processing is continued without stopping the sheet feeding (refer to FIG. 18, as well).

In the processing shown in FIG. 17, a determination on ACT 40 is added to ACT 10 in the first example, however, only the determination on ACT 40 may be performed instead of the determination on ACT 10.

According to the first to fourth examples of the second embodiment, it is possible to continue the sheet feeding without stopping when it is assumed that a user consciously lifts the sheet from the sheet feed tray 102 in order to add sheet, or the like, and as a result, the lift detection sensor 150 is turned on. For these cases, an unnecessary stop of sheet feeding is avoided even when the lift detection sensor 150 is turned on.

While certain embodiments have been described, these embodiments have been presented by way of example only, and are not intended to limit the scope of the invention. Indeed, the novel apparatuses and units described herein may be embodied in a variety of other forms; furthermore, various omissions, substitutions and changes in the form of the apparatuses and units described herein may be made without departing from the spirit of the invention. The accompanying claims and their equivalents are intended to cover such forms or modifications as would fall within the scope and spirit of the invention.

What is claimed is:

1. A sheet feed apparatus comprising:

a sheet feed tray on which a plurality of sheets is loaded;

a sheet feed roller which is provided at a forward position of the sheet feed tray in a sheet feed direction, and which feeds the loaded sheets to a conveying path;

a lift detection sensor which detects a lift of a bound sheet bundle which occurs when at least a top sheet of the bound sheet bundle is fed by the sheet feed roller or when one or more sheets are lifted from the sheet feed tray by a user; and a control unit which controls a start and stop of sheet feeding of the sheets loaded in the sheet feed tray, wherein the control unit stops the sheet feeding if the lift detection sensor detects the lift during a period after starting the sheet feeding, and does not stop the sheet feeding if the lift is detected after the period.

2. The sheet feed apparatus of claim 1, further comprising:

a sheet feed detection sensor arranged at a forward position of the sheet feed roller in the sheet feed direction, wherein the period begins when the sheet feed detection sensor detects passing of a leading edge of a sheet and ends when the sheet feed detection sensor detects passing of a trailing edge of the sheet.

3. The sheet feed apparatus of claim 1, wherein the control unit does not stop the sheet feeding if the lift is detected before the sheet feeding starts.

4. The sheet feed apparatus of claim 1, further comprising:

a load detection sensor which detects whether or not a sheet is loaded on a loading surface of the sheet feed tray, wherein the control unit does not stop the sheet feeding, if the load detection sensor detects that a sheet is not loaded in the loading surface, when the lift detection sensor detects the lift.

5. A sheet feed method comprising:

loading a plurality of sheets on a sheet feed tray;

feeding the loaded sheets into an apparatus using a sheet feed roller which is provided at a forward position of the sheet feed tray in a sheet feed direction;

detecting whether a lift of a bound sheet bundle occurs using a lift detection sensor, the lift occurring when a top sheet of the bound sheet bundle is fed by the sheet feed roller or when one or more sheets are lifted from the sheet feed tray by a user; and controlling a start and stop of sheet feeding of the sheets loaded in the sheet feed tray, wherein the sheet feeding is stopped if the lift detection sensor detects the lift during a period after starting the sheet feeding, and the sheet feeding is not stopped if the lift is detected after the period.

6. The method of claim 5, wherein the period begins when a sheet feed detection sensor arranged at a forward position of the sheet feed roller in the sheet feed direction detects passing of a leading edge of a sheet and ends when the sheet feed detection sensor detects passing of a trailing edge of the sheet.

7. The method of claim 5, the sheet feeding is not stopped if the lift detection detects the lift before the sheet feeding starts.

8. The method of claim 5, wherein if a load detection sensor detects that a sheet is not loaded in the loading surface when the lift detection sensor detects the lift, the sheet feeding is not stopped.

9. A color erasing apparatus comprising:

a sheet feed tray on which a plurality of sheets is loaded;

a sheet feed roller which is provided at a forward position of the sheet feed tray in a sheet feed direction, and which feeds the loaded sheets to a conveying path;

a lift detection sensor which detects a lift of a bound sheet bundle which occurs when a top sheet of the bound sheet bundle is fed by the sheet feed roller or when one or more sheets are lifted from the sheet feed tray by a user;

a control unit which controls a start and stop of sheet feeding of the sheets loaded in the sheet feed tray, and a color erasing unit which erases an image on a sheet fed by the sheet feed roller, wherein the control unit stops the sheet feeding if the lift detection sensor detects the lift during a period after starting the sheet feeding, and does not stop the sheet feeding if the lift is detected after the period.

10. The color erasing apparatus of claim 9, further comprising:

a reading unit which read the image on the sheet fed by the sheet feed roller, wherein the reading unit reads the image before the color erasing unit erases the image on the sheet.

* * * * *